US005685191A

United States Patent [19]

Kawano et al.

[11] Patent Number: 5,685,191

[45] Date of Patent: *Nov. 11, 1997

[54] UPPER TOOL FOR PRESS BRAKE

[75] Inventors: Susumu Kawano; Mamoru Sugimoto; Toshiro Kawano, all of Kanagawa, Japan

[73] Assignee: Amada Metrecs Company, Limited, Kanagawa, Japan

[ * ] Notice: The portion of the term of this patent subsequent to Apr. 30, 2013, has been disclaimed.

[21] Appl. No.: 431,285

[22] Filed: Apr. 28, 1995

Related U.S. Application Data

[63] Continuation-in-part of Ser. No. 239,323, May 6, 1994, and Ser. No. 259,981, Jun. 17, 1994.

[30] Foreign Application Priority Data

| | | | |
|---|---|---|---|
| May 17, 1994 | [JP] | Japan | 6-102700 |
| Jun. 30, 1994 | [JP] | Japan | 6-149777 |
| Jun. 30, 1994 | [JP] | Japan | 6-149785 |
| Aug. 19, 1994 | [JP] | Japan | 6-195434 |

[51] Int. Cl.[6] ..... B21D 37/04

[52] U.S. Cl. ..... 72/482.91; 72/462

[58] Field of Search ..... 72/389.3, 462, 72/481.3–481.9, 482.6

[56] References Cited

U.S. PATENT DOCUMENTS

| | | | |
|---|---|---|---|
| 4,534,203 | 8/1985 | Cros | 72/481.6 |
| 4,993,255 | 2/1991 | Treillet | 72/462 |
| 5,022,256 | 6/1991 | Van Der Meulen | 72/481.2 |
| 5,065,610 | 11/1991 | Yonezawa . | |
| 5,245,854 | 9/1993 | Bruggink et al. | 72/481.6 |
| 5,390,527 | 2/1995 | Kawano | 72/462 |
| 5,511,407 | 4/1996 | Kawano | 72/482.91 |
| 5,513,514 | 5/1996 | Kawano | 72/462 |

FOREIGN PATENT DOCUMENTS

| | | | |
|---|---|---|---|
| 0387121 | 9/1990 | European Pat. Off. . | |
| 0446810 | 9/1991 | European Pat. Off. . | |
| 569880 | 11/1993 | European Pat. Off. | 72/481.7 |

(List continued on next page.)

OTHER PUBLICATIONS

A Japanese Patent Abstract, vol. 12, No. 145 (M693).

An English Language Abstract of JP 6–23436.

An English Language Abstract of JP 5–317973.

An English Language Abstract of JP 3006018.

Patent Abstracts of Japan, vol. 18, No. 227 (M–1597) of Apr. 25, 1994 and Japanese Patent Document No. 06–023436.

(List continued on next page.)

*Primary Examiner*—David Jones

*Attorney, Agent, or Firm*—Greenblum & Bernstein P.L.C.

[57] ABSTRACT

In an upper tool for a press brake formed with an inclined surface (9S) narrowed upwardly at an upper portion thereof and an engage groove (9G) formed under the inclined surface (9S). The inclined surface (9S) is brought into contact with an inclined surface of an upper tool clamp member (11), when the upper tool is clamped between an upper tool holder body (5) and an upper tool clamp member (11), in such a way that clamping force can be further increased when the upper tool is engaged with a die (63). Further, in an upper tool holder apparatus for a press brake, the pivotal upper tool clamp member (211) is formed with an engage projection (211P) for engaging a drop prevention groove (205G) formed in the upper tool (205). The upper tool holder apparatus further comprises a clamp operation lever (215) which can be selectively moved to a clamp position "A" at which the clamping force can be applied to the upper tool clamp member (211) from a clamping force generating spring (213) to clamp the upper tool tightly; an unclamp position "B" at which the clamping force can be reduced to allow the upper tool to be adjustably shifted horizontally, and an exchange position "C" at which the upper tool clamp member (211) can be moved way from the upper tool to allow the upper tool to be exchanged vertically with another one.

21 Claims, 15 Drawing Sheets

FOREIGN PATENT DOCUMENTS

| | | | |
|---|---|---|---|
| 2540756 | 8/1984 | France . | |
| 2598946 | 11/1987 | France . | |
| 2609909 | 7/1988 | France . | |
| 2691652 | 10/1993 | France . | |
| 749638 | 5/1943 | Germany . | |
| 3136440 | 3/1983 | Germany . | |
| 4115224 | 11/1992 | Germany . | |
| 57-199523 | 10/1982 | Japan . | |
| 6254524 | 3/1987 | Japan . | |
| 62-212019 | 9/1987 | Japan | 72/481.7 |
| 62-267019 | 11/1987 | Japan . | |
| 05317973 | 12/1993 | Japan . | |
| 5-317973 | 12/1993 | Japan | 72/481.6 |
| 5-317974 | 12/1993 | Japan | 72/481.6 |
| 5-337553 | 12/1993 | Japan | 72/481.6 |
| 5317973 | 12/1993 | Japan . | |
| 0623436 | 2/1994 | Japan . | |
| 6-47462 | 2/1994 | Japan | 72/481.6 |
| 6-142767 | 5/1994 | Japan | 72/481.6 |
| 3006018 | 10/1994 | Japan . | |

OTHER PUBLICATIONS

Patent Abstracts of Japan, vol. 8, No. 146 (M–307) of Jul. 7, 1984 and Japanese Patent Document No. 59–042124.

Patent Abstracts of Japan, vol. 18, No. 168 (M–1580) of Mar. 22, 1994 and Japanese Patent Document No. 05–0337553.

UPPER TOOL FOR PRESS BRAKE

CROSS REFERENCE TO RELATED APPLICATION

This is a continuation-in-part of applications Ser. No. 08/239,323 filed May 6, 1994, pending and Ser. No. 08/259,981 filed Jun. 17, 1994, pending, both which are expressly incorporated by reference herein in its entirety.

BACKGROUND OF THE INVENTION

1. Field of the Invention

The present invention relates to an upper tool for a press brake. More specifically, the present invention relates to an upper tool which can actuate the upper tool holder apparatus so that an upper tool clamping force can be increased when the upper tool is clamped by the upper tool holder apparatus.

2. Description of Related Art

A press brake is provided with an upper table (referred to as an upper apron, sometimes) and a lower table (referred to as a lower apron, sometimes) in mutually opposing positional relationship with respect to each other. Further, any one of the upper and lower tables is driven in the vertical direction as a ram.

Further, in the press brake, an upper tool (referred to as a punch) is attached to the upper table and further a lower tool (referred to as a die) is attached to the lower table in order to bend plate-shaped work to various desired shapes.

In the above-mentioned construction of the press brake, when the movable-side table is moved up and down to engage the upper tool with the die, the work positioned between the upper tool and the die can be bent.

In the press brake, in general, since the upper tools must be exchanged according to the bending shapes of work, a number of upper tool holders are arranged on the lower portion of the upper table. That is, a plurality of upper tools are supported by a plurality of upper tool holders so as to be exchanged with respect to each other.

In the conventional upper tool holder apparatus, an upper tool clamp member is attached to a holder body mounted on the lower portion of the upper table, and further fastened by use of fastening bolts, so that the upper portion of the upper tool can be strongly clamped between the holder body and the upper tool clamp member.

In the conventional upper tool holder, therefore, in order to exchange a plurality of upper tools attached to the upper table, a plurality of fastening bolts of the upper tool holder members must be rotated, thus causing a problem in that the upper tool exchange work is troublesome.

To overcome this problem, an upper tool holder apparatus such that the upper tools can be fastened or unfastened by use of an air cylinder mounted on the upper tool holder apparatus has been developed.

In the upper tool holer apparatus of this type, however, since an air cylinders must be provided for a plurality of upper tool holder apparatus, respectively and since an air source is additionally necessary, there exists another problem in that the construction of the upper tool holder apparatus is complicated and thereby the cost thereof is relatively high.

Further, in the conventional upper tool holder apparatus, there exists such a dancer that the upper tool drops when the upper tool is released from of an upper tool clamping force of the upper tool holder apparatus.

Further, in the conventional upper tool holder apparatus, the upper tool clamp member must be half fastened to such an extent that the upper tool does not drop for alignment with the die, and after that the upper tool clamp member must be full fastened tightly after the upper tool and die have been aligned with each other. As a result, there exists another problem in that the tool setting work is troublesome.

As prior art examples related to the present invention, there are EP 0 387 121 A1 (the first prior art) and Japanese Published Unexamined (Kokai) Patent Application No. 6-23436 (the second prior art).

In the first prior art press brake, although the upper tool can be clamped between the upper clamp member pivotally supported by the upper table and the holder body, since the upper tool must be attached to or removed from the upper table by pivoting the upper tool so as not to interfere with a pivotal axle of the upper tool clamp member; that is, since the upper tool must be pivoted by supporting the upper tool as heavy as 20 to 30 kg manually on the front side of the press brake, there exists a problem in that this work is dangerous for the worker (in particular for the worker's hand and waist.

In addition, when a plurality of upper tools are clamped by connecting the upper tools in the longitudinal (horizontal) direction thereof, there exists a problem in that it is impossible to insert and connect an end of another upper tool between and with the already clamped upper tools so that a plurality of upper tools can be arranged in a longitudinal direction thereof.

Further, in the first prior art press brake, since the upper tool is clamped between the upper tool clamp member (pivotally supported by the upper table) and the holder body, the upper tool must be exchanged by pivoting the upper tool so as not to interfere with a pivotal axle of the upper tool clamp member, so that there exists another problem in that the shape of the upper tool is not simple, that is, complicated and thereby the upper tool cannot be processed easily.

In the second prior art press brake, the upper tool can be attached to or removed from the upper tool holder apparatus by pivoting an operation lever provided on the upper tool holder apparatus from a clamp position to an unclamp position or vice versa to facilitate the upper tool exchange. However, the upper tool is exchanged by the upper tool holder apparatus by shifting the upper tool in the longitudinal (the right and left) direction, when some upper tool elements of a series of the split type upper tools of different lengths are required to be exchanged at the middle portion thereof, there exists a problem in that the upper tool exchange work is rather troublesome.

Here, the conventional upper tool holder apparatus (not the prior art) will be explained in further detail with reference to FIGS. 25A and 25B. In the drawings, an upper tool clamp member 403 is attached to an upper holder body 401 fixed to a lower portion of an upper table (not shown). Therefore, an upper tool 407 can be fixed or clamped between the clamp member 403 and the upper tool holder body 401 when the clamp member 403 is fastened by use of a fastening bolt 405. Therefore, whenever the upper tools 407 are required to be exchanged with other upper tools, a great number of fastening bolts 405 must be rotated to unfasten and fasten the upper tool clamp members 403, with the result that the upper tool exchange work is troublesome.

Further, in the upper tool 407, it is desirable that an angle ulower end surface 409E of an upper support portion 409 of the upper holder body 401) and a sliding surface 407F slidable in contact with a vertical surface 409F of the upper tool support portion 409 is formed accurately at 90 degrees in correspondence to the angle between the lower surface 409E and the vertical surface 409F of the upper support body 409. In general, however, this angle is process as θ<90 degrees to prevent θ>90 degrees under consideration of the processing error. The reason is as follows: if θ>90 degrees, as shown in FIG. 25A exaggeratively, a gap is produced between the lower end surface 409E of the upper tool support portion 409 and the shoulder portion 407S. Therefore, when work is bent, the upper tool 407 is deformed in a direction that this gap is reduced. As a result, the lower end portion 407E of the upper tool 407 is deformed relatively large (due to the punching pressure) in accompany with this deformation due to the pressure of this gap, thus degrading the bending precision.

On the other hand, if θ<90 degrees, as shown in FIG. 25B exaggeratively, a gap is produced between the vertical surface 409F of the upper tool support portion 409 and the sliding surface 407F of the upper tool 407. Therefore, when the upper tool clamp member 403 is fastened strongly by the fastening bolt 405, since the upper tool 407 is deformed in such a way that the gap is reduced, there exists the case where the lower end portion 407 E of the upper tool 407 is dislocated slightly.

Here, since the fastening force applied to the fastening bolt 405 differs according to the worker, the deformation at the lower end portion 407E of the upper tool 407 differs according to the worker and/or worker's fatigued conditions.

Therefore, in the work bending processing by exchanging the upper tools, even if the above-mentioned angle is formed so precise as to lie within an allowable range, there exists a problem in that a high precise bending processing cannot be achieved, when the upper tools cannot be exchanged at a high upper tool exchange reproducibility.

SUMMARY OF THE INVENTION

With these problems in mind, therefore, it is the object of the present invention to provide an upper tool, which can be exchanged easily at a high upper tool exchange reproducibility by use of the upper tool holder apparatus, and further which will not be dropped ever if released from the upper tool clamping force.

To achieve the above-mentioned objects, the present invention provides an upper tool for a press brake, elastically clamped between a support plate (7) of an upper tool holder body (5) attached to a lower portion of an upper table (3) and an upper tool clamp member (11), characterized in that the upper tool (9) is formed with an inclined surface (9S) narrowed upward at an upper portion thereof and with an engage groove (9G) engaged with an engage projection (11K) of the upper tool clamp member (11) and formed under the inclined surface (9S), the inclined surface (9S) being brought into contact with an inclined surface of the upper tool clamp member (11) when the upper tool is clamped between the upper tool holder body (5) and the upper tool clamp member (11) in such a way that clamping force can be further increased when the upper tool is engaged with a die (63).

Further, an inclination angle (θ) of the inclined surface (9S) of the upper tool is about 7 to 11 degrees from a vertical line of the upper tool.

Further, a lower surface (9GL) of the engage groove (9G) of the upper tool is formed at a position vertically higher than a contact surface (9F) brought into contact with a lower end surface (7E) of the support plate (7E) of the holder body (5).

Further, a short vertical surface (9SV) is formed between the inclined surface (9S) and the engage groove (9G) to allow the upper tool to be clamped by an ordinary upper tool holder apparatus.

Further, an upper surface (9GF) of the engage groove (9G) is slightly inclined downward from a horizontal line inward to urge the upper tool against the support plate (7).

Further, a distance H between the lower surface (7E) of the support plate (7) and an upper surface (9F) of the upper tool (9) obtained when the upper surface of the engage groove (9G) of the upper tool is in contact with the engage projection (11K) of the upper tool clamp member (11) is determined as follows:

$$H=(B^2\cdot P)/(A^2\cdot K\cdot \tan\theta))$$

where A denotes a distance between a pivotal center of the upper tool clamp member (11) and elastic means for generating a clamping force to the upper tool clamp member; B denotes an average distance between the pivotal center of the upper tool clamp member and a clamping force application point; P denotes the clamping force applied to the upper tool clamp member; K denotes an elastic coefficient of the elastic means; and θ denotes the inclination angle of the inclined surface (9S) of the upper tool from the vertical line.

Further, it is preferable that the inclined surface (9S) of the upper tool is hardened by attaching a hard metal on the surface thereof or by coating a hard metal on the surface thereof.

Further, the present invention provides an upper tool for an upper tool holder apparatus for a press brake, for clamping an upper tool (205) between an upper tool support portion (209) of an upper tool holder body (207) attached to a lower portion of an upper table (203) and a pivotal upper tool clamp member (211) by a clamping force generated by clamping force generating means (213), characterized in that: the pivotal upper tool clamp member(211) is formed with an engage projection (211P) engaged with a drop prevention groove (205G) formed in the upper tool (205); and in that the upper tool holder apparatus further comprises clamp operating means (215) for selectively moved to a clamp position A at which the clamping force can be applied to the upper tool clamp member (211) from the clamping force generating means (213) to clamp the upper tool tightly, an unclamp position B at which the clamping force can be reduced to allow the upper tool to be adjustably shifted horizontally, and an exchange position C at which the upper tool clamp member (211) can be moved way from the upper tool to allow the upper tool to be exchanged vertically with another one.

Further, the clamp operating means (215) comprises: a pusher member (259P) for pushing the clamping force generating means (213) to generate the clamping force of said clamping force generating means (213); an operation lever (265); and a clamping force control means (263) attached to said operation lever, controllably brought into contact with and separated from said pusher member (259P) to control the clamping force applied from said clamping force generating means (213) to the upper tool.

Further, the upper tool holder apparatus further comprises upper tool clamp member urging means (217) for urging the upper tool clamp member (211) slightly in clamp direction when said clamp operating means (215) is moved to the exchange position C. The upper tool clamp member urging means (217) is at least one coil spring disposed between the upper tool clamp member (211) and the upper tool holder body (207).

Further, the clamping force control means attached to said operation lever (265) is a pusher screw (263) fixed to said operation lever and thread-engaged with the upper tool clamp member (211), said pusher screw being shifted relative to the upper tool clamp member (211) when rotated by said operation lever.

Further, the upper tool holder apparatus further comprises clamp release holding means (219) for holding the upper tool clamp member (211) in a clamping force released state, to form an upper tool exchange space between the upper tool clamp member (211) and the upper tool support portion (209), under condition that said clamp operating means (215) is at the exchange position C.

Further, the clamp release holding means (219) comprises:

an engage recess (279) formed in the upper tool clamp member (211); and a plunger (218) attached to the holder body (207) so as to be engageable with said engage recess, when the upper tool clamp member (211) is pivoted away from the upper tool support portion (209).

Further, the upper tool holder apparatus further comprises two clamp operation lever stopping means (271) for stopping the moved clamp operation lever (265) at the unclamp position B and the exchange position C, respectively. Each of said clamp operation lever stopping means (271) comprises: a pin (275) attached to a side surface of a slot (273) formed in a mounting plate (225); a stopper member (271) pivotally supported by said pin so as to be projected or retracted from a surface of the mounting plate; and a plunger (277) attached to the mounting plate to hold said stopper at the projected or retracted position, respectively.

Further, the upper tool holder apparatus further comprises; a wedge piece (247) attached above the engage projection (211P) formed in the upper tool clamp member (211) so as to be engaged with the drop prevention groove (205G) formed in the upper tool (205); and a coil spring (249) for urging said wedge piece in a direction that the clamped upper tool can be urged in clamping direction.

Further, the present invention provides an upper tool holder apparatus for a press brake, for clamping an upper tool (305) between an upper tool support portion (313) of an upper tool holder body (301) attached to a lower portion of an upper table (303) and an upper tool clamp member (309) by a fastening member (327), characterized in that an elastic member (329) for elastically clamping the upper tool between the upper tool support portion (313) and the upper tool clamp member (309) is interposed between the upper tool clamp member (309) and the fastening member (327).

Further, the upper tool clamp member (309) is formed with an inclined surface (309F) widened downward at an upper portion thereof and brought into contact with an inclined surface (305F) of an upper tool (305) when the upper tool is clamped between the upper tool support portion (313) and the upper tool clamp member (309) in such a way that the clamping force can be further increased when the upper tool is engaged with a die (63).

Further, the fastening member (327) is composed of a threaded portion (327S) thread-engaged with the upper tool holder body (313) and a cylindrical body portion (327B) for determining a constant space for disposing the upper tool clamp member (309) and the elastic member (329).

Further, the upper tool clamp member (309) is formed with an engage projection (309P) engaged with an engage groove (305F) formed in the upper tool (305).

Further, right and left side edges (309C) of the upper tool clamp member (309) are chamfered to facilitate insertion of the upper tool between the upper tool support portion (313) and the upper tool clamp member (309).

Further, the present invention provides an upper tool for a method of clamping an upper tool (305) between an upper tool holder body (307) attached to an upper table (303) of a press brake and an upper tool clamp member (309) by an elastic clamping force of an elastic member, which comprises the steps of: fastening a fastening member (327) for urging the upper tool clamp member (309) formed with an inclined surface (309F) toward the upper tool holder body (307) to determined a previously determined constant space between the upper tool holder body and the upper tool clamp member; inserting the upper tool (305) formed with an inclined surface (305F) into the predetermined space from below in such a way that the upper tool inclined surface (305F) is brought into contact with the clamp member inclined surface (309F); and engaging the upper tool (305) with a die (337) by moving any one of the upper tool and die to move the upper tool upward relative to the upper tool holder body (307) and thereby to compress an elastic member (329) interposed between the fastening member (327) and the upper tool clamp member (309) always at a constant compression rate due to a wedge effect between the two inclined surfaces of the upper tool and the upper tool clamp member, whereby the upper tool can be clamped between the upper tool holder body (307) and the upper tool clamp member (309) always by a constant clamping force.

In the upper tool according to the present invention, when the upper tool is moved upward relative to the support plate of the upper tool holder apparatus during the engagement thereof with the die, since the upper tool clamping force can be increased gradually, it is possible to facilitate the exchange work of the upper tool by the use of the upper tool holder apparatus.

Further, when the upper tool is clamped by the upper tool holder apparatus, since an appropriate clamping force can be always obtained, it is possible to prevent the upper tool from being dropped due to lack of sufficient clamping force, while facilitating the upper tool exchange work.

Further, whenever the upper tool is exchanged, since the upper tool can be supported by the upper tool clamp member, the upper tool exchange work can be facilitated in safety. Further, since the vertical surface of the upper tool is used as the clamping surface, the upper tool according to the present invention can be clamped to the upper table by use of the ordinary upper tool clamp member.

Further, the upper tool holder apparatus, since the clamping force control means (the pusher screw) is thread-engaged with the upper tool clamp member and further since the clamp operation means (the operation lever) fixed to the pusher screw is selectively pivoted to the clamp position A for firmly clamping the upper tool, an unclamp position B for shifting the upper tool horizontally for upper tool adjustment and alignment, and further to the exchange position C for upper tool exchange, it is possible to adjust and exchange the upper tool easily and safely.

Further, since the upper tool clamp member urging means (the coil springs) are provided, when the operation lever is pivoted to the unclamp position B, the upper tool clamp member can be urged slightly in the clamp direction, so that it is possible to prevent the upper tool from being dropped during the upper tool adjustment or alignment.

Further, since the clamp release holding means (the engage recess and the ball plunger) are provided, when the operation lever is pivoted to the exchange position C, the upper tool clamp member can be kept away from the upper tool, so that it is possible to exchange the upper tool with a new one in the vertical direction easily.

Further, since the stopper members are provided for determining the clamp position A and the unclamp position B of the operation lever, it is possible to easily pivot the operation lever to the respective positions.

Further, since the wedge piece is provided on the engage projection of the upper tool so as to be engaged with the drop prevention groove of the upper tool, it is possible to reduce the gap between the engage projection of the upper tool clamp member and the drop prevention groove of the upper tool for improvement of the upper tool drop.

Further, the upper tool holder apparatus, the upper tool can be exchanged easily by use of the upper tool holder apparatus. Further, whenever the upper tools of the same upper wedge dimension are exchanged, since the clamping force of the upper tool can be kept at a constant value, it is possible to obtain an excellent reproducibility of the alignment between the upper tool and the die, ever after the upper tools are exchanged for various bending process. As a result, the upper tool exchange work can be facilitated and further the bending precision can be improved.

DETAILED DESCRIPTION OF THE EMBODIMENTS

Figure 1:
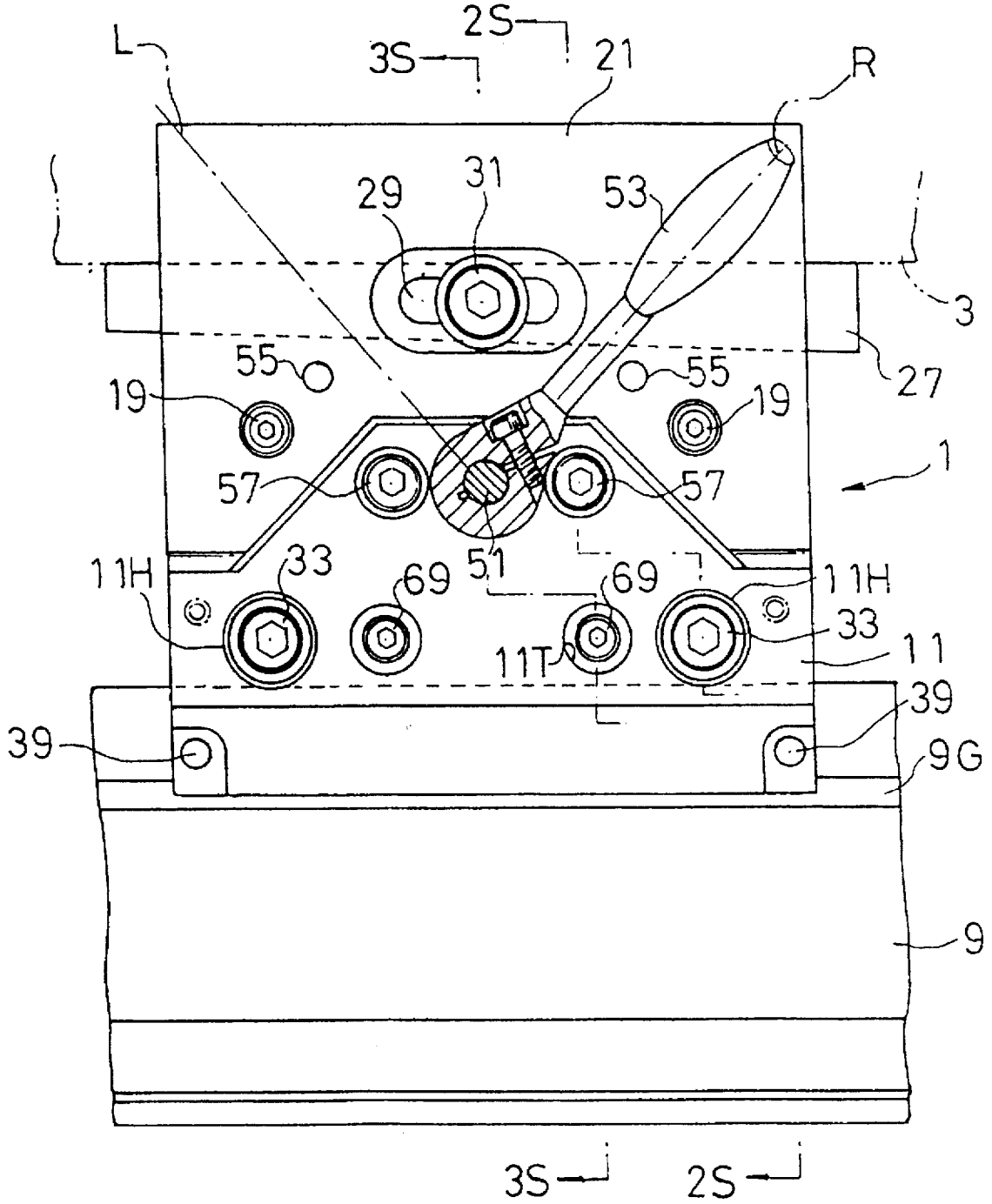
FIG. 1 is a front view showing a first embodiment of the upper tool holder apparatus according to the present invention.

First, the whole construction of the upper tool (punch) holder apparatus 1 will be described hereinbelow with reference to FIGS. 1 to 3.

The upper tool holder apparatus 1 of the present invention is removably attached to the lower portion of an upper table 3 of a press brake (not shown).

The upper tool holder apparatus 1 is composed of a holder body 5 removably attached to the upper table 3 and having a support plate 7, an upper tool clamp member 11 pivotally supported by the holder body 5 to clamp the upper portion 9U of an upper tool (punch) 9 in cooperation with the support plate 7 of the holder body 5, a clamping force adjusting device 13 for adjusting the clamping force applied to the upper tool clamp member 11, and a clamping force releasing device 15 for releasing the clamping force applied from the upper tool clamp member 11 to the upper tool 9. Further, a small pivotal contact member 17 is attached to end portion of the upper tool clamp member 11 in such a way that a contact surface 17S thereof is brought into slidable contact with an inclined surface 9S of the upper tool 9, as shown in FIG. 2.

Figure 2:
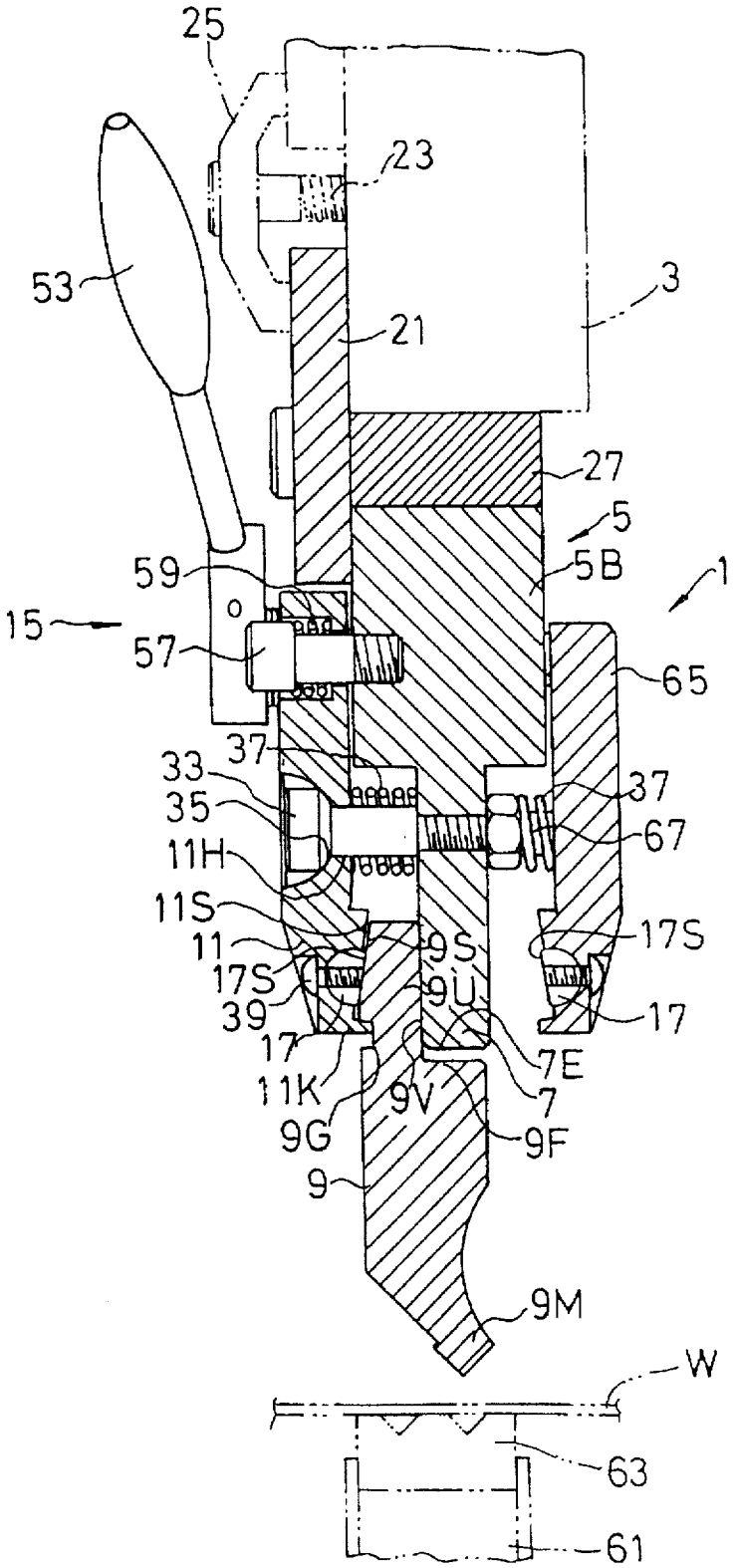
FIG. 2 is a cross-sectional view, taken along the line 2S—2S shown in FIG. 1.
Figure 3:
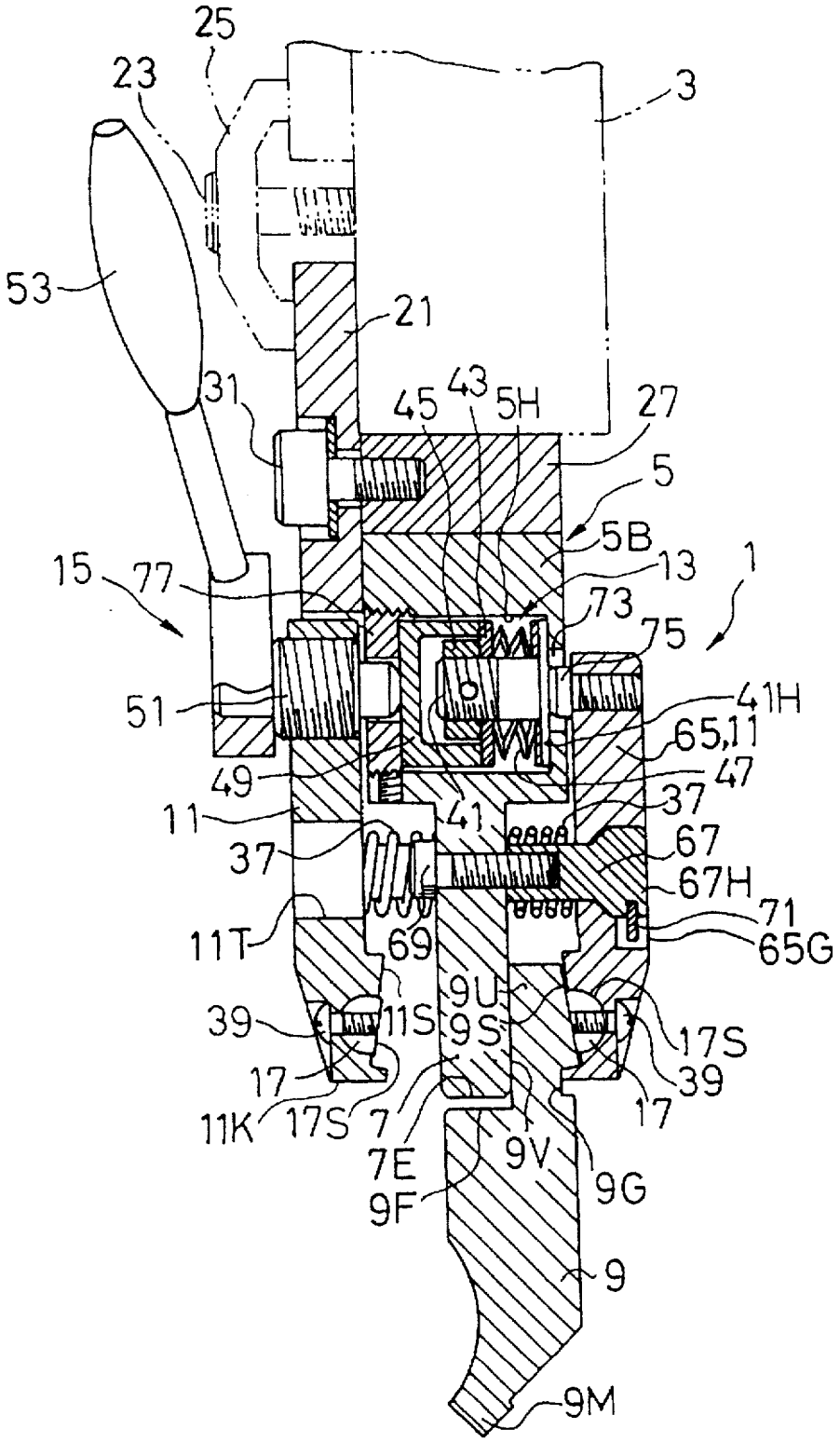
FIG. 3 is a cross-sectional view, taken along the line 3S—3S shown in FIG. 1.

In more detail, the holder body 5 is composed of a thick-wall upper block portion 5B and a thin-wall support plate 7 formed integral with each other (when the thickness is seen from the right and left direction in FIGS. 2 and 3). Further, a mounting plate 21 is fixed to the front surface (the left side in FIG. 2) of the upper block 5B of the holder body 5 with a plurality of bolts 19 (See FIG. 1).

Therefore, when the mounting plate 21 is brought into contact with the lower front surface of the upper table 3 and after that a clamp jaw 25 is fastened with a fastening bolt 23 to the upper table 3, the mounting plate 21 can be urged against the upper table 3, so that the holer body 5 can be fixed to the upper table 3.

To adjust the vertical position of the holder body 5, a wedge member 27 is interposed between the upper surface of the holder body 5 and the lower surface of the upper table 3. A fixing bolt 31 passed through a slot 29 (See FIG. 1) formed in the front mounting plate 21 so as to extend in the right and left direction is thread-engaged with the wedge member 27 (See FIG. 3).

In the above-mentioned construction, under the conditions that the clamp jaw 25 is slightly fixed to such an extent that the holder body 5 will not drop and further the fixing bolt 31 is slightly loosened, when the wedge member 27 is adjusted in the right and left direction in FIG. 1, it is possible to finely adjust the vertical position of the holder body 5 relative to the upper table 3.

The upper tool clamp member 11 is a plate member having roughly the same width as that of the holder body 5 (in FIG. 1), and pivotally supported by the holder body 5 via a plurality of mounting bolts 33 (when seen in FIG. 2). Therefore, the upper portion 9U of the upper tool 9 is clamped between the lower end of the upper tool clamp member 11 and the support plate 7 of the upper tool holder body 5.

In more detail, the upper tool clamp member 11 is supported by a plurality of mounting bolts 33 passed through a plurality of through holes 11H formed at a vertically middle portion of the upper tool clamp member 11 and thread-engaged with the support plate 7 in the horizontal direction so as to be pivotal in the front and rear direction (the right and left direction in FIG. 2). To facilitate the pivotal motion of the upper tool clamp member 11, the contact surfaces between the head of the respective mounting bolts 33 and the upper tool clamp member 11 are formed into a spherical shape, respectively. Further, an elastic body 37 (e.g., coil spring, rubber body, etc.) is interposed between the upper tool clamp member 11 and the support plate 7 to keep these two members away from each other.

Further, at the lower portion of the upper tool clamp member 11, an inclined surface 11S is formed so as to approach the support plate 7 at the upper portion thereof. Further, a contact member 17 is attached to the inclined surface 11S so as to be pivotal slightly.

In more detail, two through holes are formed on both sides of the lower portion of the upper tool clamp member 11 (See FIG. 1). A mounting bolt 39 is passed through each of the through holes and further thread-engaged with the contact member 17. A clearance is formed between each through hole and the mounting bolt 39, so that the contact member 17 can be pivotal slightly relative to the upper tool clamp member 11.

Further, an engage projection 11K is formed at the lower portion of the upper tool clamp member 11 (below the contact member 17) so as to be engaged with an engage groove 9G (extending in the right and left direction in FIG. 1) formed in the upper tool 9.

The upper tool clamp member 11 serves to give a force for clamping the upper tool 9 in cooperation with the support plate 7. Further, a clamping force adjusting device 13 (See FIG. 3) for adjusting the upper tool clamping force is fitted to a horizontal hole 5H formed in the upper block portion 5B of the holder body 5.

In more detail, as shown in FIG. 3, the clamping force adjusting device 13 is composed of an adjust screw 41, a nut member 45 thread-engaged with the adjust screw 41 to adjust the position of a ring member 43 movably engaged with the adjust screw 41, and an elastic member (e.g., spring) 47 interposed between a head portion 41H of the adjust screw 41 and the ring member 43.

In the above-mentioned construction, when the adjust screw 41 is adjustably rotated, since the engage position between the adjust screw 41 and the nut member 45 can be shifted, the compression force or the clamping force of the elastic member 47 can be adjusted. Here, the head portion 41H of the adjust screw 41 of the clamping force adjusting device 13 is in contact with the bottom wall portion of the hole 5H, and further a cylindrical push member 49 enclosing the nut member 45 is in contact with the ring member 43, as shown in FIG. 3.

Further, an end portion of a fastening screw 51 of the clamping force releasing device 15 (provided at the upper portion of the upper tool clamp member 11) is in contact with the push member 49. In more detail, the clamping force releasing device 15 is a fastening screw 51 passed through and thread-engaged with the upper portion of the upper tool clamp member 11. Further, a lever 53 is fixed to the fastening screw 51.

Accordingly, when the lever 53 is pivoted, the fastening screw 51 is fastened toward or unfastened away from the push member 49 to apply or release the upper tool clamping force of the clamping force adjusting device 13.

Further, to limit the pivotal range of the lever 53, two stopper pins 55 are implanted in the mounting plate 21, as shown in FIG. 1.

In the above-mentioned construction, under the condition that the upper portion 9U of the upper tool 9 is interposed between the upper tool clamp member 11 and the support plate 7 of the holder body 5, when the lever 53 of the clamping force releasing device 15 is pivoted to the right side R in FIG. 1 to fasten the fastening screw 51, since the elastic member 47 of the clamping force adjusting device 13 is further compressed, the elastic force of the elastic member 47 increases, so that the upper tool 9 can be clamped by the upper tool clamp member 11 by a stronger force due to a reactive elastic force thereof.

In contrast with this, when the lever 53 of the clamping force releasing device 15 is pivoted to the left side L in FIG. 1 to unfasten the fastening screw 51, since the elastic member 47 of the clamping force adjusting device 13 is released from compression, the elastic force of the elastic member 47 decreases, so that the upper tool 9 can be unclamped from the upper tool clamp member 11.

As described above, when the lever 53 is pivoted in the right and left direction in FIG. 1, the upper tool clamp member 11 is pivoted in the right and left direction in FIG. 2 to clamp or unclamp the upper tool 9 in cooperation of the support plate 7.

Further, a clamp opening springs 59 is interposed between each of the two bolts 57 (passed through the upper portion of the upper tool clamp member 11 and thread-engaged with the holder body 5 as shown in FIG. 2) and the holder body 5, so that the lower portion of the upper tool clamp member 11 can be opened, whenever the upper tool 9 is unclamped.

As described above, the upper tool clamp member 11 can clamp and unclamp the upper tool 9 at the fixed position.

The upper tool 9 removably attached to the upper tool holder apparatus 1 constructed as described above will be explained hereinbelow with reference to FIG. 4.

The upper tool 9 is formed with a contact surface 9F brought into contact with the lower end surface 7E of the support plate 7. Further, a vertical sliding surface 9V brought into slidably contact with the front 7F or rear surface of the support plate 7 is formed in the upper portion 9U projecting from the contact surface 9F of the upper tool 9. An engage groove 9G is formed on a surface opposite to the sliding surface 9V of the upper tool 9. In addition, a short vertical surface 9SV is formed between the inclined surface 9S formed above the engage groove 9G and the engage groove 9G.

The vertical surface 9SV can be used when the upper tool 9 is clamped by the ordinary upper tool clamp member.

Further, the upper tool 9 is formed with a work processing portion 9M at the lower end portion thereof to bend work W in cooperation with a die (lower tool) 63 attached to the lower table 61 as shown in FIG. 2.

Figure 4:
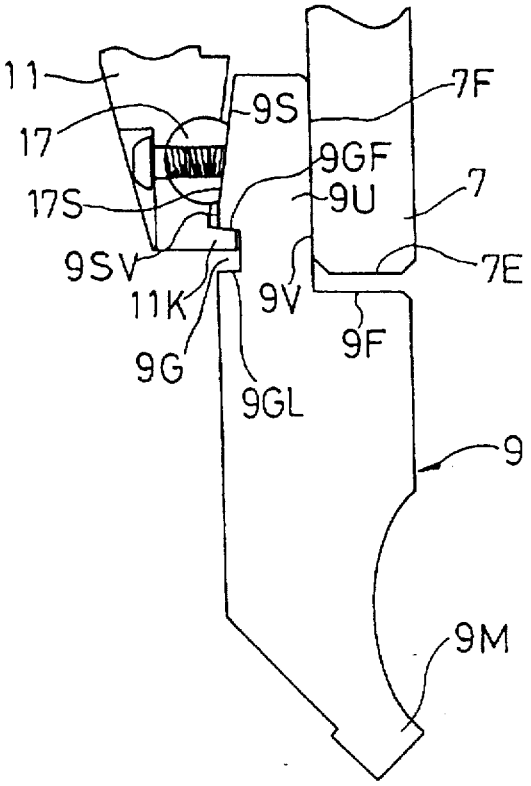
FIG. 4 is a partial side view showing the shape of the upper tool according to the present invention.

As understood by FIG. 4, the lower surface 9GL of the engage groove 9G of the upper tool 9 is formed at a position higher than the contact surface 9F thereof. Further, the upper surface 9GF of the engage groove 9G is formed so as to be slightly inclined downward toward the groove bottom in correspondence to the upper surface of the engage projection 11K of the upper tool clamp member 11.

In the above-mentioned construction, since the lower end portion of the upper tool clamp member 11 can be determined relatively short at a position higher than the lower end surface 7E of the support plate 7, it is possible to prevent the upper tool clamp member 11 from interfering with work W bent at an acute angle, for instance.

Further, when the upper tool 9 is engaged with the upper tool clamp member 11 under the condition that the engage projection portion 11K of the upper tool clamp member 11 is in contact with the upper surface 9GF of the engage groove 9G of the upper tool 9, since the contact surface of the engage projection portion 11K is slightly inclined downward, it is possible to always urge the vertical sliding surface 9V of the upper tool 9 against the support plate 7 due to the weight of the upper tool 9.

Further, since the engage groove 9G of the upper tool 9 is located at a position higher than the contact surface 9F thereof, the width of the upper portion 9U of the upper tool 9 from a corner (at an intersection between the contact surface 9F and the sliding surface 9V) can be increased, so that the strength of the upper tool 9 can be increased.

In the upper tool 9 as described above, the upper tool 9 can be attached to the upper tool holer apparatus 1 in the procedure as follows:

First, the lever 53 of the clamping force releasing device 15 is pivoted to the position R to fasten the fastening screw 51. Even under the condition that the fastening screw 51 is fastened, a gap can be formed between the lower portion of the upper tool clamp member 11 and the support plate 7.

Therefore, the upper portion 9U of the upper tool 9 can be inserted between the upper tool clamp member 11 and the support plate 7 horizontally (in the right and left direction in FIG. 1) in such a way that the engage groove 9G formed in the upper tool 9 is engaged with the engage projection 11K of the lower portion of the upper tool clamp member 11 as shown in FIG. 2 and further the inclined surface 9S of the upper tool 9 is in contact with the contact surface 17S of the contact member 17.

After that, the movable table (any one of the upper table 3 and the lower table 61) of the press brake is moved in the vertical direction to engage the upper tool 9 with the die 63. Therefore, the upper tool 9 is moved upward relative to the holder body 5.

When the upper tool 9 is moved upward gradually toward the holder body 5, the inclined surface 9S of the upper tool 9 urges the lower portion of the upper tool clamp member 11 in the leftward direction via the contact member 17 in FIGS. 2 and 4, so that the upper tool clamp member 11 is pivoted clockwise in FIG. 2 to gradually compress the elastic member 47 of the clamping force adjusting device 13.

Accordingly, when the upper tool 9 is moved upward and thereby the contact surface 9F is brought into contact with the lower end surface 7E of the support plate 7, the upper tool 9 can be clamped strongly by the upper tool clamp member 11 on the basis of an elastic force of the elastic member 47. Therefore, the upper tool 9 can be easily clamped by the upper tool holder apparatus 1.

As described above, after the upper tool 9 has been clamped by the upper tool holder apparatus 1, the upper tool 9 can be removed from the upper tool holder apparatus 1 as follows: First, the lever 53 is pivoted to the left side L to loosen the fastening screw 51. Then, the upper tool 9 is released from the upper tool clamp member 11.

When the upper tool 9 has been released from the upper tool clamp member 11, the upper tool 9 drops to the original lower position (as shown in FIG. 2) by the weight of itself. In this case, since the upper surface 9GF of the engage groove 9G of the upper tool 9 is engaged with the engage projection 11K of the upper tool clamp member 11, it is possible to prevent the upper tool 9 from being dropped, so that the upper tool removal operation is safe.

After the upper tool 9 has been released from the upper tool clamp member 11 as described above, the upper tool 9 can be removed from the upper tool holder apparatus 1 by shifting the upper tool 9 horizontally in the right and left direction in FIG. 1.

As explained above, in the upper tool 9 and the upper tool holder apparatus 1 according to the present invention, it is possible to easily clamp or unclamp the upper tool 9 by use of the upper tool holder apparatus 1, without use of any tools, in spite of the simple construction.

Further, as already understood, when the upper tool 9 is engaged with the die 63, since the lower portion of the upper tool clamp member 11 is urged upward or clockwise by the inclined surface 9S of the upper tool 9, the clamping force of the upper tool 9 between the upper tool clamp member 11 and the support plate 7 can be increased gradually as the upper tool 9 is moved upward. Therefore, it is possible to consider that the upper tool clamp member 11, the clamping force adjusting device 13, etc. constitutes a kind of clamping force increasing mechanism such that when the upper tool 9 is moved upward relative to the support plate 7, the clamping force can be increased gradually.

In the above-mentioned construction, although the clamping force adjusting device 13 having the elastic member 47 is used as a part of the clamping force increasing mechanism, it is also possible to adopt a hydraulic (e.g., gas) cylinder including a compressive fluid (gas) instead of the clamping force adjusting device 13. Further, it is also possible to replace the upper tool clamp member 11 with a leaf spring to use the elastic deformation of the upper tool clamp member itself, without use of the clamping force adjusting device 13. In other words, various constructions can be adopted as the clamping force increasing mechanism of the upper tool holer apparatus 1.

Further, in the upper tool holder apparatus 1 of the present invention, the upper tool 9 can be attached to the rear surface of the support plate 7 by inverting the front and rear sides of the upper tool 9, as shown in FIG. 3. In other words, a rear side upper tool clamp member 65 is pivotally provided on the rear surface of the support plate 7 in such a way that the upper tool 9 can be clamped between the rear side upper tool clamp member 65 and the rear surface side of the support plate 7.

In more detail, as shown in FIG. 3, a stud 67 having a semi-spherical head 67H is attached horizontally to the rear surface of the support plate 7 of the holder body 5 with the use of a mounting bolt 69. Further, the upper tool clamp member 65 is pivotally supported by the head 67H of this stud 67. To rotate the stud 67, a tool hole 11T is formed in the front-side upper tool clamp member 11. Further, a stop pin 71 engaged with a groove 65G formed in the upper tool clamp member 65 is attached to the head 67H of the stud 67.

Therefore, even when the mounting bolt 69 is rotated, the stud 67 will not be rotated together with the mounting bolt 69.

To use the clamping force adjusting device 13 in common for both the front-side upper tool clamp member 11 and the rear-side upper tool clamp member 65, a small diameter hole 73 is formed in the bottom wall portion of the hole 5H of the holder body 5. Further, a contact member 75 thread-engaged with the upper portion of the rear-side upper tool clamp member 65 is passed through the small diameter hole 73 and further brought into contact with the head 41H of the adjust screw 41.

Further, on the front side of the hole 5H, a ring nut 77 for stop the movement of the push member 49 of the clamping force adjusting device 13 is thread-engaged with the holder body 5.

In the construction as described above, when the mounting bolt 69 is fastened, the upper tool 9 can be clamped between the rear-side upper tool clamp member 65 and the rear surface of the support plate 7. In contrast with this, when the mounting bolt 69 is loosened, the upper tool 9 can be released from the rear-side upper tool clamp member 65.

Further, when an appropriate plate member is pinched between the front-side upper tool clamp member 11 and the support plate 7 to keep the front-side upper tool clamp member 11 unmoved, it is possible to clamp and unclamp the upper tool 9 between the support plate 7 and the rear-side upper tool clamp member 65 by pivoting the lever 53.

As described above, the upper tool 9 can be selectively clamped between any one of the upper tool clamp members 11 and 65 and any one of the front and rear surfaces of the support plate 7 according to the bending shape of work W. In addition, the upper tool 9 can be exchanged easily by use of the upper tool holder apparatus 1.

As described above, in the upper tool holder apparatus according to the present invention, the upper tool 9 can be easily exchanged by use of the upper tool holer apparatus 1. In this exchange work, even if the upper tool 9 is released from the clamping force of the upper tool holder apparatus 1, since the upper tool 9 will not drop, it is possible to improve the safety of the upper tool holer apparatus 1.

As already explained, when the upper tool 9 is moved upward relative to the support plate 7 of the upper tool holer apparatus 1 and thereby the inclined surface 9S of the upper tool 9 urges the lower portion of the upper tool clamp member 11, the clamping force of the upper tool clamp member 11 increases gradually. Therefore, it is necessary to obtain a sufficiently large clamping force when the contact surface 9F of the upper tool 9 is brought into contact with he lower end surface 7E of the support plate 7.

Figure 5:
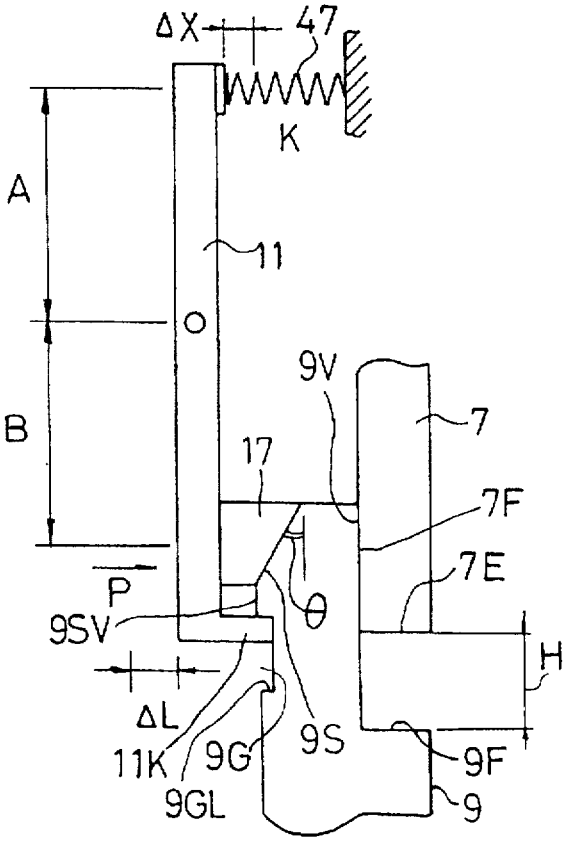
FIG. 5 is an illustration for assistance in explaining the relationship between the upper tool and the upper tool holer apparatus.

Therefore, when the upper surface 9GF of the engage groove 9G of the upper tool 9 is in contact with the upper surface of the engage projection 11K of the upper tool clamp member 11, as shown in FIG. 5, it is preferable that the distance H between the contact surface 9F of the upper tool 9 and the lower end surface 7E of the support plate 7 satisfies the following relationship:

$$H=(B^2\cdot P)/(A^2\cdot K\cdot \tan\theta)$$

where A denotes the distance between a pivotal center of the upper tool clamp member 11 and the elastic means 47 of the clamping force adjusting device 13 for urging the upper tool clamp member 11; B denotes an average distance between a pivotal center of the upper tool clamp member 11 and a clamping force application point (at which the upper tool clamp member 11 pushes the upper tool 9 against the support plate 7 via the contact member 17); P denotes the clamping force for pushing the upper tool 9 against the support plate 7; K denotes the elastic coefficient (modulus of elasticity) of the elastic member 47; and the inclined surface 9S from the vertical line.

Here, when the upper tool 9 is moved upward relative to the support plate 7, as shown in FIG. 5, the lower portion of the upper tool clamp member 11 is displaced leftward by $\Delta L$ and the upper portion of the upper tool clamp member 11 is displaced rightward by $\Delta X$, so that the elastic member 47 is compressed gradually to increase the clamping force gradually.

Here, it is not desirable that the distance H is smaller than that expressed by the above formula. This is because when the contact surface 9F of the upper tool 9 is brought into contact with the lower end surface 7E of the support plate 7 by a slight upward movement of the upper tool 9 relative to the support plate 7, a sufficient clamping force cannot be obtained. As a result, there exists a danger that the upper tool 9 drops.

In contrast with this, when the distance H is larger than that expressed by the above formula, when the contact surface 9F of the upper tool 9 is in contact with the lower end surface 7E of the support plate 7, since the displacement rate of the elastic member 47 becomes larger than $\Delta X$, a large clamping force can be obtained. In this case, however, there exists such a case that when the upper tool 9 is required to be released by pivoting the lever 53, the upper tool 9 cannot be released sufficiently due to an excessive clamping force, so that it becomes difficult to exchange the upper tool 9 by use of the upper tool holder apparats 1. Therefore, this is also not desirable.

Accordingly, it is desirable that the inclination angle $\theta$ of the inclined surface 9S of the upper tool 9 lies between 5 and 20 degrees. That is, when the inclination angle is less than 5 degrees, the distance H must be increased to deform the elastic member 47 sufficiently. Further, when more than 20 degrees, although the distance H can be reduced, this is not desirable because the downward component force becomes large.

On the other hand, in order to hold the upper tool 9 so as not to be dropped by its weight, it is necessary to increase the frictional force between the inclined surface 9S of the upper tool 9 and the contact surface 17S of the contact member 17 beyond the weight of the upper tool 9. The frictional force (the maximum static friction force) can be expressed as (static friction coefficient×contact force), and the friction coefficient can be expressed as tan $\theta$ (where $\theta$ is a friction angle).

The friction coefficient changes according to the surface conditions of the inclined surface 9S and the contact surface 17S (i.e., surface roughness, material, presence or absence of lubricant, etc.). However, since the friction coefficient between two metals usually lies between 0.15 and 0.20, it is desirable that the inclination angle $\theta$ of the inclined surface 7S lies between 7 and 11 degrees.

Figure 6:
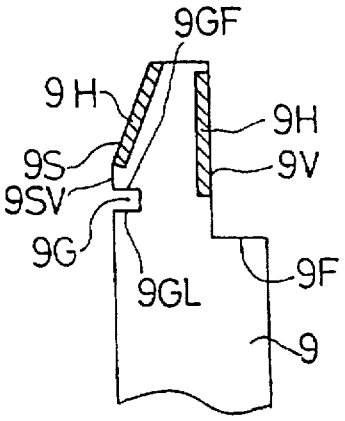
FIG. 6 is a side view showing a modification of the upper tool according to the present invention.

Further, the upper tool holder apparatus according to the present invention can be modified as follows:

As shown in FIG. 6, it is also preferable to form a high hardness portion 9H at the inclined surface 9S and the sliding surface 9H of the upper tool 9, in order to improve the abrasion resistance. To form the high hardness portion 9H, a hard alloy chip is attached onto the surfaces, or the surfaces are coated with a hard material or quenched.

With reference to FIGS. 7 to 10, other upper tool holder apparatus for holding the upper tool 9 according to the present invention will be explained.

Figure 7:
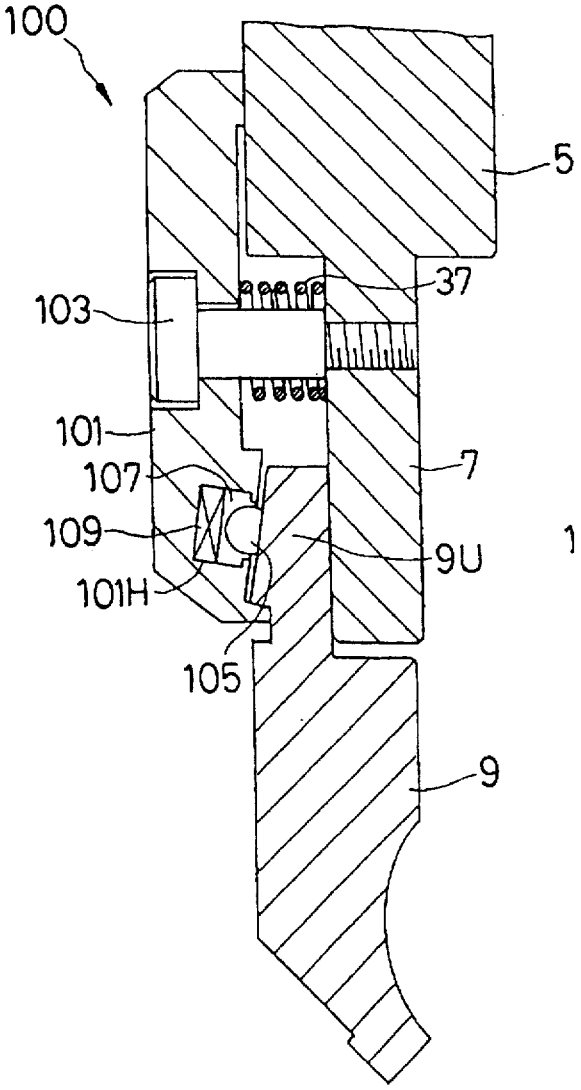
FIG. 7 is a side view showing a modification of the upper tool holder apparatus according to the present invention.

In the upper tool holder apparatus 100 shown in FIG. 7, an upper tool clamp member 101 is fastened to the support plate 7 of the holder body 5 by use of a bolt 103, and further a clamp piece 105 is provided at the lower portion of the upper tool clamp member 101.

The clamp piece 105 is formed into a semi-spherical or semi-cylindrical shape, and pivotally supported by a slider 107 slidably fitted to a hole 101H formed in the lower portion of the upper tool clamp member 101. Further, an elastic member 109 (such as a dish spring, urethane rubber, etc.) is interposed between the slider 107 and the bottom portion of the hole 101H of the upper tool clamp member 101.

In this embodiment, when the bolt 103 is fastened, the space between the support plate 7 of the holder body 5 and the upper tool clamp member 101 can be kept constant, so that the space between the support plate 7 and the clamp piece 105 can be also kept constant.

To clamp the upper tool 9 by the upper tool holder apparatus 100, the upper portion 9U of the upper tool 9 is inserted between the support plate 7 and the clamp pieced 105 horizontally in the right and left direction (perpendicular to the paper). After that, when the upper tool 9 is moved upward relative to the holder body 5 due to the engagement with a die (not shown), since the elastic member 109 is compressed, the upper tool 9 can be urged against the support plate 7 by the elastic force of the elastic member 109. Further, the upper tool 9 can be released when the bolt 103 is loosened.

Figure 8:
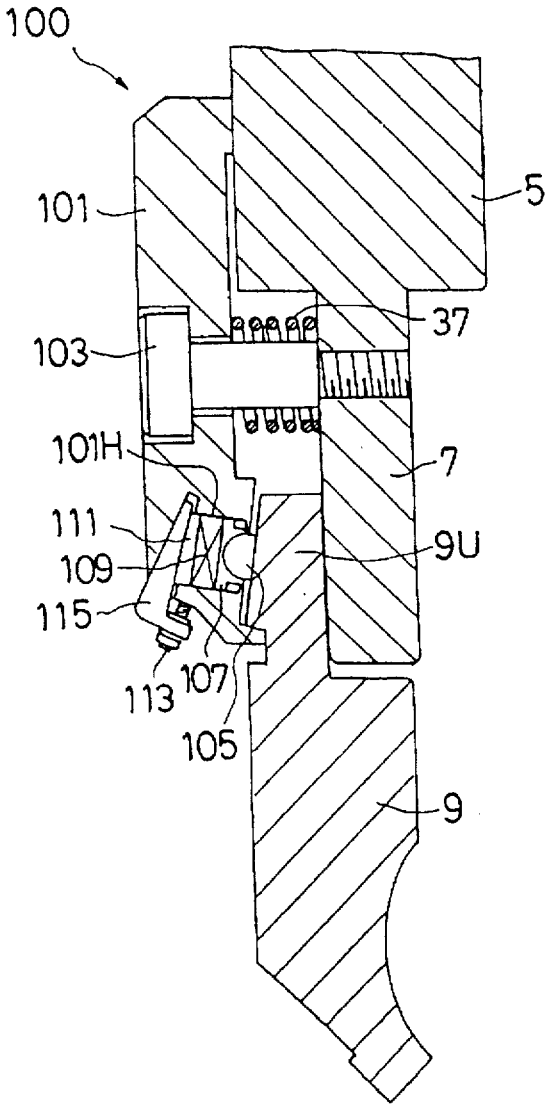
FIG. 8 is a side view showing another modification of the upper tool holder apparatus according to the present invention.

In the case of an upper tool holder apparatus shown in FIG. 8, a wedge-shaped spring washer 111 is disposed at the bottom portion of the hole 101H formed in an upper tool clamp member 101 in such a way as to be adjusted by another wedge member 11S moved by an adjust screw 113. The structure other than the above is the same as that shown in FIG. 7.

In this modification, when the wedge 115 is moved by the adjust screw 113, the elastic force of the elastic member 109 can be adjusted via a spring washer 111.

Figure 9:
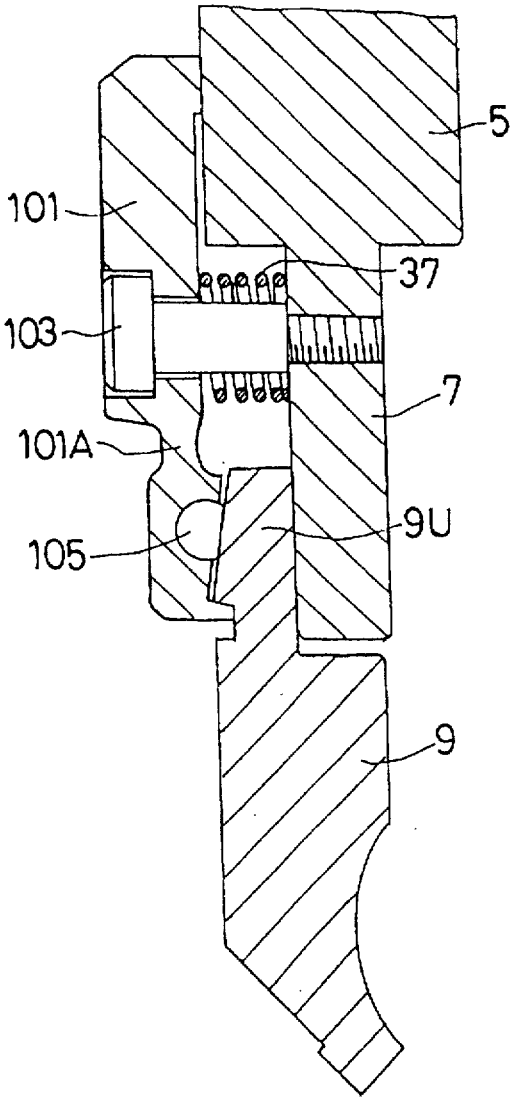
FIG. 9 is a side view showing still another modification of the upper tool holder apparatus according to the present invention.

In the case of an upper tool holder apparatus shown in FIG. 9, a thin-wall portion 101A is formed at a part of the upper tool clamp member 101 in such a way as to be deformed elastically. In other words, the upper tool clamp member 101 itself is provided with the elastic member.

Figure 10:
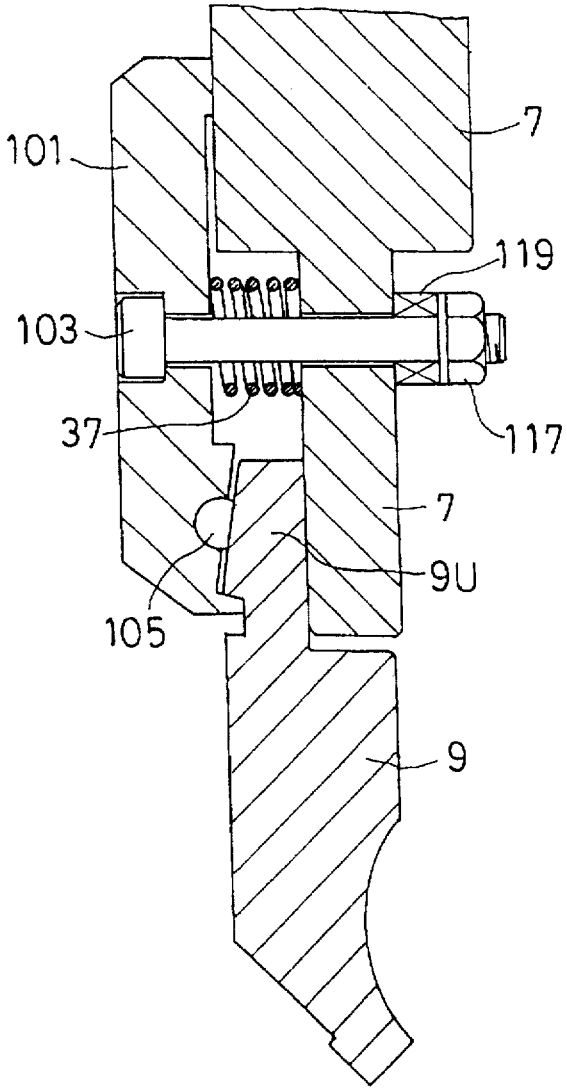
FIG. 10 is a side view showing the other modification of the upper tool holder apparatus according to the present invention.

In the case of the upper tool holder apparatus shown in FIG. 10, a bolt 103 is passed through the support plate 7, and an elastic member 119 is interposed between a nut member 117 thread-engaged with the end of the bolt 103 and the support member 7.

As described above, in the upper tool clamped by the upper tool holder apparatus according to the present invention, when the upper tool is moved upward relative to the support plate of the upper tool holder apparatus during the engagement thereof with the die, since the upper tool clamping force can be increased gradually, it is possible to facilitate the exchange work of the upper tool by the use of the upper tool holder apparatus.

Further, when the upper tool is clamped by the upper tool holder apparatus, since an appropriate clamping force can be always obtained, it is possible to prevent the upper tool from being dropped due to lack of sufficient clamping force, while facilitating the upper tool exchange work.

Further, whenever the upper tool is exchanged, since the upper tool can be supported by the upper tool clamp member, the upper tool exchange work can be facilitated in safety. Further, since the vertical surface of the upper tool is used as the clamping surface, the upper tool according to the present invention can be clamped to the upper table by use of the ordinary upper tool clamp member.

A second embodiment of the upper tool holder apparatus according to the present invention will be described hereinbelow with reference to FIGS. 11 and 12.

The upper tool holder apparatus 201 of the present embodiment is removably attached to the lower portion of an upper table 203 of a press brake (not shown). Further, a plurality of the upper tool holder apparatus 201 are mounted being arranged at appropriate intervals horizontally in the right and left direction of the lower portion of the upper table 203 in FIG. 11. In other words, since various types of the upper tools 205 such as a single long upper tool (extending horizontally in the right and left direction perpendicular to FIG. 12), a plurality of split-type upper tools of different short lengths, etc. are used for a press brake, a plurality of the upper tool holder apparatus 29 are arranged at intervals on the upper table 203.

Figure 11:
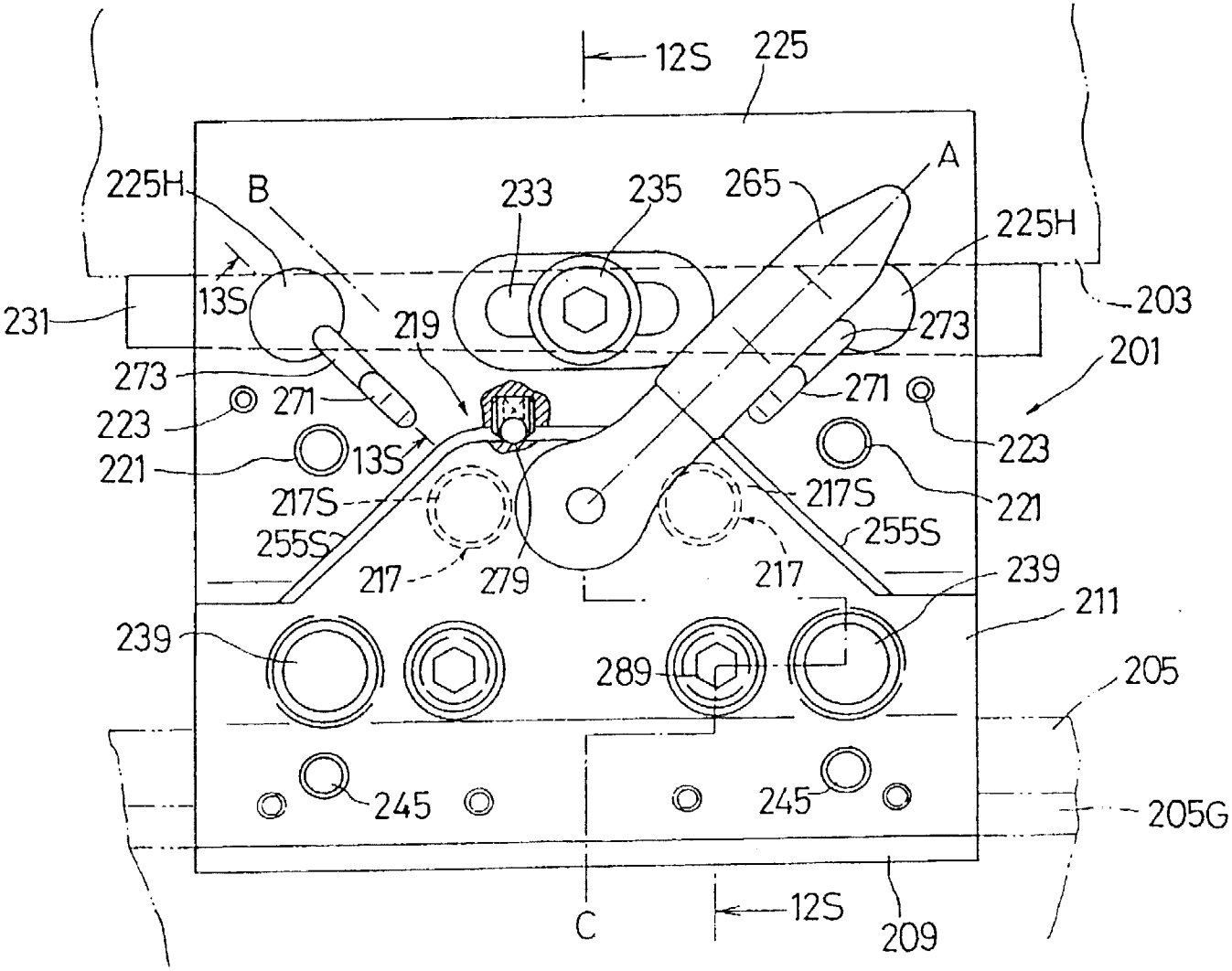
FIG. 11 is a front view showing a second embodiment of the upper tool holder apparatus according to the present invention.
Figure 12:
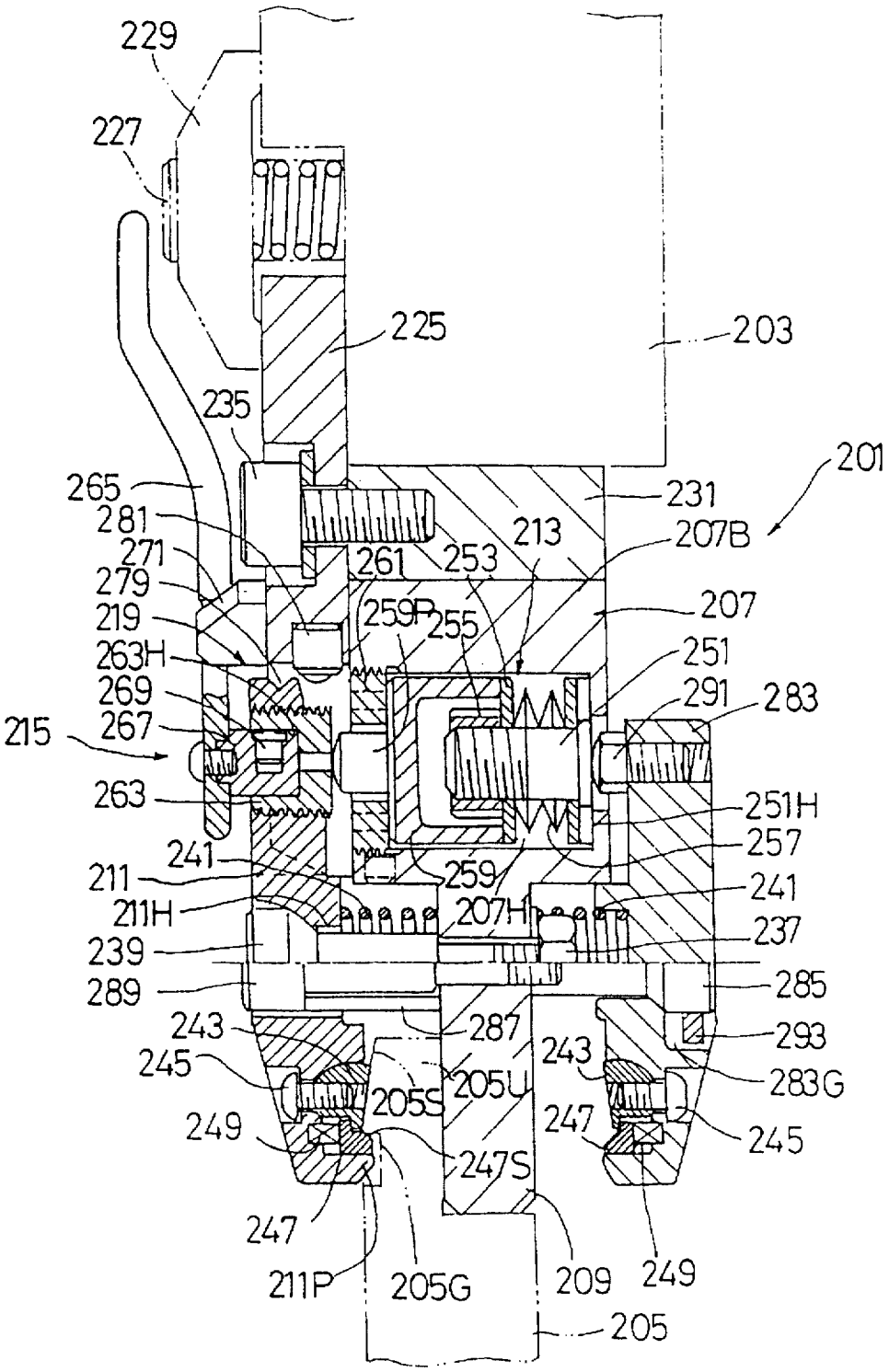
FIG. 12 is a cross-sectional view, taken along the line 12S—12S shown in FIG. 11.

As shown in FIG. 12, the upper tool holder apparatus 201 is composed of a holder body 207 removably attached to the upper table 203 and having an upper tool support portion 209 at the lower portion thereof, an upper tool clamp member 211 for clamping an upper portion 205U of an upper tool 205 in cooperation with the upper tool support portion 209 of the holder body 207, clamping force generating means (e.g., a spring) 213 for applying a clamping force to the upper tool clamp member 211, clamp operating means (e.g., a lever) 215 for controllably transmitting a clamping force of the clamping force generating means 213 to the upper tool clamp member 211, upper tool clamp member urging means (springs) 217 (See FIG. 11) for slightly urging the upper tool clamp member 211 in the upper tool clamp direction, and clamp release holding means 219 for keeping the upper tool clamp member 211 in the clamp release state (for upper tool exchange) against the urging force of the upper tool clamp member urging means 217.

In more detail, the holder body 207 is formed with a thick-wall upper block portion 207B and a thin-wall lower support plate 209 both integral with each other (when seen from the right and left direction in FIG. 12). Further, a mounting plate 225 projecting upward is fixed to the front surface (the left side in FIG. 12) of the upper block portion 207B of the holder body 207 with a plurality of bolts 221 and pins 223 (both shown in FIG. 11).

As shown in FIG. 11, the mounting plate 225 is formed with a cutout portion 255C widened downward at the lower middle portion thereof. Further, as shown in FIG. 12, the upward projecting portion of the mounting plate 225 is brought into contact with the front lower portion of the upper table 203. When a clamp jaw 229 is fastened with a fastening bolt 227 thread-engaged with the upper table 203, the upper projecting portion of the mounting plate 225 is fixed to the upper table 203, so that the holder body 207 can be fixed to the upper table 203.

Further, in the above-mentioned embodiment, although the holder body 207 and the mounting plate 225 are provided separately and fixed to each other, it is also possible to form the holder body 207 and the mounting plate 225 integral with each other. In this case, the mounting plate 225 is regarded as a part of the holder body 207.

To adjust the vertical position of the holder body 207, a wedge member 231 is adjustably interposed between the upper surface of the holder body 207 and the lower surface of the upper table 203 so as to be movable horizontally in the right and left direction (in FIG. 11). A fixing bolt 235 passed through a slot 233 (extending in the right and left direction in FIG. 11) formed in the mounting plate 225 is thread-engaged with the wedge member 231.

In the above-mentioned structure, under the conditions that the clamp jaw 229 is slightly fastened to such an extent that the holder body 207 will not drop and further the fixing bolt 235 is loosened, when the wedge member 231 is adjustably moved horizontally in the right and left direction in FIG. 11, the vertical position of the holder body 207 can be adjusted finely relative to the upper table 203.

The upper tool clamp member 211 is a plate member having a width roughly the same as that of the holder body 207. Further, the upper tool clamp member 211 is formed with a projection fitted to the downward-widened cutout portion 255C formed in the mounting plate 225. The upper tool clamp member 221 is pivotally supported by the holder body 207 to clamp and unclamp the upper portion 205U of the upper tool 205.

In more detail, a plurality of through holes 211H are formed at the vertically middle portion of the upper tool clamp member 211. A plurality of mounting bolts 239 are passed through these through holes 211H, thread-engaged with the upper tool support portion 209 horizontally, and further fixed by nuts 237, respectively. Therefore, the upper tool clamp member 211 can be pivotally supported by head portions of the mounting bolts 239. Further, a coil springs 241 is elastically interposed between the upper tool support portion 209 and the upper tool clamp member 211, respectively.

Further, the contact surfaces of the head portion of the mounting bolt 239 and the through hole 211H are both formed into a spherical surface, respectively to allow the upper tool clamp member 211 to be pivoted smoothly.

At the lower portion of the upper tool clamp member 211, an engage projection 211P engaged with a drop prevention groove 205G formed at the upper portion of the upper tool 205 (extending in the right and left direction in FIG. 11) is formed so as to project toward the upper tool support member 209. Further, a push contact member 243 brought into contact with the inclined surface 205S of the upper portion 205U of the upper tool 205 to urge the upper tool 205 against the upper tool support portion 209 is provided slightly above the engage projection 211P.

The push contact member 243 is formed by cutting parts of the circumferential surface of a cylindrical body into flat surfaces, and mounted at the lower portion of the upper tool clamp member 211 via a plurality of screws 245 so as to be pivoted slightly when seen in FIG. 12.

Further, a wedge member 247 engaged with the drop prevention groove 205G of the upper tool 205 is provided between the engage projection 211P of the upper tool clamp member 211 and the push contact member 243. This wedge member 247 is always urged by an elastic member 249 such as a coil spring interposed between the upper tool clamp member 211 and the wedge member 247 in the direction as to be engaged with the drop prevention groove 205G of the upper tool 205.

However, the horizontal movement of the wedge member 247 by the elastic member 249 is restricted when brought into contact with a part of the push contact member 243. Further, the upper rear-side (right side in FIG. 12) end surface of the wedge member 247 is chamfered (247S) to facilitate engagement with and disengagement from the drop prevention groove 205G of the upper tool 205.

The clamping force generating means 213 is provided in a hole 207H formed in the block portion 207B of the holder body 207. The clamping force generating means 213 applies a clamping force for urging the upper tool 205 against the upper tool support portion 209 of the holder body 207, via the push contact member 243 provided at the lower portion of the upper tool clamp member 211.

In more detail, as shown in FIG. 12, the clamping force generating means 213 is composed of an adjust screw 251, a ring member 253 slidably fitted to the adjust screw 251, a nut member 255 thread-engaged with the adjust screw 251, and an elastic member 257 such as a dish spring interposed between the head 251H of the adjust screw 251 and the ring member 253.

The head portion 251H of the adjust screw 251 is in contact with the bottom wall of the hole 207H. Further, one end of the cylindrical push member 259 enclosing the nut member 255 and slidably fitted into the hole 207H is in contact with the ring member 253. The other end of the push member 259 is in contact with a ring nut 261 adjustably thread-engaged with the hole 207H of the holder body 207. Further, a pin-shaped pusher member 259P provided at the other end of the cylindrical push member 259 projects from the ring nut 261 to the left side in FIG. 12.

The clamp operating means 215 for transmitting the clamping force of the clamping force generating means 213 to the upper tool clamp member 211 is provided above the upper tool clamp member 211.

In more detail, the clamp operating means 215 has a clamping force control member (a pusher screw) 263 thread-engaged with the upper portion of the upper tool clamp member 211. Therefore, the pusher screw 263 can be pivoted together with the upper tool clamp member 211. The clamping force control member (pusher screw) 263 is brought into contact or away from the pin-shaped pusher member 259P.

In this embodiment, therefore, when the pusher screw 263 is loosened relative to the upper tool clamp member 211, the pusher screw 263 is moved deep into the upper tool clamp member 211 away from the pin-shaped pusher member 259P. In contrast with this, when the pusher screw 263 is fastened, the pusher screw 263 is slightly brought into contact with the pin-shaped pusher member 259P. When further fastened, since the pin-shaped pusher member 259P strongly pushes the cylindrical push member 259 and thereby the elastic member 257 is compressed, a strong clamping force can be obtained as a reaction force of the elastic member 257.

To rotate the clamping force control means (pusher screw) 263, an operation lever 265 is removably attached to the pusher screw 263. That is, an engage hole 263H is formed in the pusher screw 263, and an engage block 267 of the operation lever 265 is engaged with the engage hole 263H. Further, a ball plunger 269 is attached to the engage block 267 in such a way as to be engaged with an groove (not shown) formed in the engage hole 263H. This ball plunger 269 prevents the engage block 267 from being rotated relative to the pusher screw 263.

When the engage hole 263H is formed into an oval shape or gear shape, since the engage block 267 will not be rotated relative to the pusher screw 263, it is possible to omit the ball plunger 269.

In the structure as described above, when the operation lever 265 is pivoted, it is possible to pivot the pusher screw 263 as to be moved to or away from the pin-shaped pusher member 259P to control the clamping force of the clamping force generating means 213.

In more detail, the operation lever 265 can be pivoted to a clamp position A (See FIG. 11) at which the upper tool clamp member 211 clamps the upper tool 205 in cooperation with the upper tool support portion 209, to an unclamp position B at which the upper tool clamp member 211 unclamps the upper tool 205 (so that the upper tool 205 can be shifted horizontally in the right and left direction in FIG. 11) for upper tool horizontal position adjustment, and to an exchange position C at which the upper tool 205 can be removed vertically from the upper tool clamp member 211 for upper tool exchange. Further, two stoppers 271 (See FIG. 11) are attached to the mounting plate 225 to locate the operation lever 265 at the clamp and unclamp positions A and B, respectively.

Figure 13:
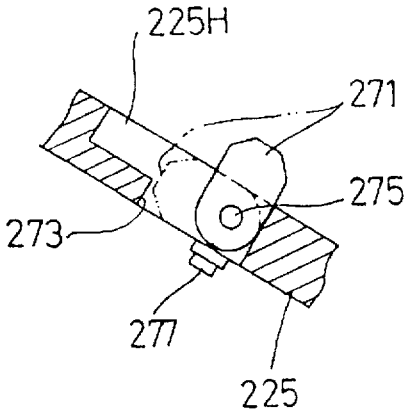
FIG. 13 is a cross-sectional view, taken along the line 13S—13S shown in FIG. 11.

In more detail, as shown in FIG. 11, two slits 273 are formed in the mounting plate 225 at such positions as to correspond to the clamp and unclamp positions A and B, respectively. As shown in FIG. 13, a stopper member 271 is pivotally supported via a pin 275 in such a way as to project from or retract from the front surface of the mounting plate 225. Further, a recessed portion 225H communicating with the slit 273 is additionally formed in the mounting plate 225 so that the stopper member 271 can be easily pivoted upward and downward relative to the surface of the mounting plate 225. Further, a ball plunger 277 engaged with a recessed portion formed in the outer circular-arc shaped portion of the stopper member 271 is attached to the mounting plate 225 to keep the raised stopper member 271 and retracted stopper member 271 at its position, respectively.

The upper tool clamp member urging means 217 (See FIG. 11) push and urge the upper tool clamp member 211 so that the upper tool 205 can be urged slightly against the upper tool support portion 209. The upper tool clamp member urging means 217 are elastic members 217S such as coil springs interposed between the upper portion of the upper tool clamp member 211 and the block portion 207B of the holder body 207, as shown in FIG. 11.

The clamp release holding means 219 holds the upper tool clamp member 211 at such a position that the upper tool 205 is perfectly released from the upper tool clamp member 211, against an elastic force of the upper tool clamp member urging means 217. The clamp release holding means 219 is a ball plunger 281 attached on the mounting plate 225 and engaged with an engage recess 279 (e.g., groove, hole, etc.) formed in the upper portion of the upper tool clamp member 211. Further, it is also possible to form the recessed portion 279 in the mounting plate 225 and to attach the ball plunder 281 to the upper tool clamp member 211, in the opposite way thereto.

The operation of the upper tool holder apparatus according to the present invention will be described hereinbelow with reference to FIGS. 11 and 12.

Under the condition that the upper tool 205 is clamped between the upper support portion 209 of the holder body 207 and the upper tool clamp member 211, as shown by dot-dot-dashed lines in FIG. 12, when the operation lever 265 is pivoted to the clamp position A, since the clamping force control member (the pusher screw) 263 is fastened inward, the pin-shaped pusher member 259P pushes the cylindrical pusher member 259, so that the elastic member 257 of the clamping force generating means 213 is further compressed. Therefore, since the elastic force of the elastic member 257 further increases, the upper tool clamp member 211 is urged counterclockwise by a reaction force thereof in FIG. 12, so that the upper tool 205 can be firmly clamped further strongly between the upper tool clamp member 211 and the upper tool support portion 209.

In contrast with this, when the operation lever 265 is pivoted to the unclamp position B, since the clamping force control member (the pusher screw) 263 is loosened outward away from the pusher member 259P, the pin-shaped pusher member 259P is in slight contact with the cylindrical pusher member 259, so that the upper tool clamp member 211 is released from the clamping force into the unclamp condition. Under these conditions, however, since the engage projection 211P of the upper tool clamp member 211 is engaged with the drop prevention groove 205G of the upper tool 205, the upper tool 205 can be shifted horizontally for adjustment or alignment in the right and left direction in FIG. 11.

Here, when the stopper member 271 provided at the unclamp position B is pushed down deep into the slit 273 formed in the mounting plate 225 and further the operation lever 265 is pivoted counterclockwise to the exchange position C, since the pusher screw 263 is shifted deep into the upper tool clamp member 211 being separated in the left direction in FIG. 12, the pusher screw 263 is kept far away from the pin-shaped pusher member 253P of the clamping force generating means 213. That is, the upper tool clamp member 211 is perfectly released from the clamping force generating means 213. Here, the upper tool clamp member 211 is pivoted counterclockwise for safety by a weak elastic force of the elastic members 217S of the upper tool clamp member urging means 217 (shown in FIG. 11). Under these conditions, when the worker pivots the upper tool clamp member 211 clockwise manually, since the engage recessed portion 279 formed at the upper portion of the upper tool clamp member 211 is engaged with the ball plunger 281, the upper tool clamp member 211 is kept away from the upper tool support portion 209 for upper tool exchange. Here, it should be noted that since the pin-shaped pusher screw 263 is sufficiently shifted leftward relative to the upper tool clamp member 211, the cylindrical pusher member 259P will not interfere with the pusher member 263, when the recessed portion 279 is engaged with the ball plunger 281. That is, under the condition that the recessed portion 279 is engaged with the ball plunger 281, since the lower portion of the upper tool clamp member 211 is kept opened away from the upper tool support portion 209, the upper tool 205 can be exchanged by moving the upper tool 205 in the vertical direction relative to the upper tool clamp member 211.

Further, under the condition that the engage portion 279 of the upper tool clamp member 211 is engaged with the ball plunger 281, when the operation lever 265 is returned clockwise from the exchange position C to the unclamp position B, since the pusher screw 263 projects from the upper tool clamp member 211 into contact with the pin-shaped pusher member 259P (the clamping force generating means 213), the upper tool clamp member 211 is pivoted counterclockwise again in FIG. 12, so that the ball plunger 281 is disengaged from the recessed portion 279 of the upper tool clamp member 211.

The upper tool exchange procedure of the upper tool holder 201 apparatus according to the present invention will be explained in further detail with reference to FIGS. 14 to 18.

Figure 14A:
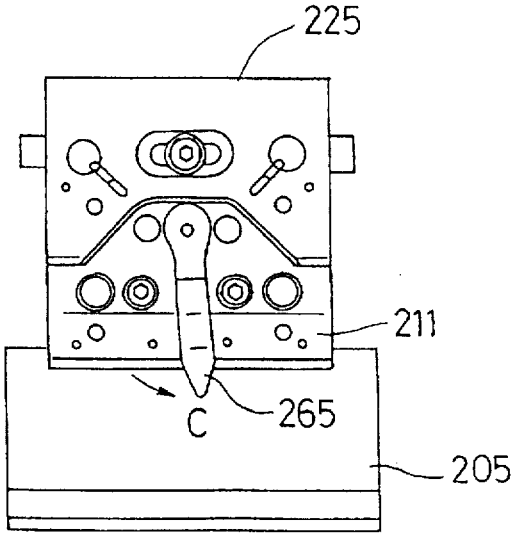
FIGS. 14A and 14B are illustrations for assistance in explaining the function when the operation lever is pivoted to the exchange position C for upper tool exchange.
Figure 14B:
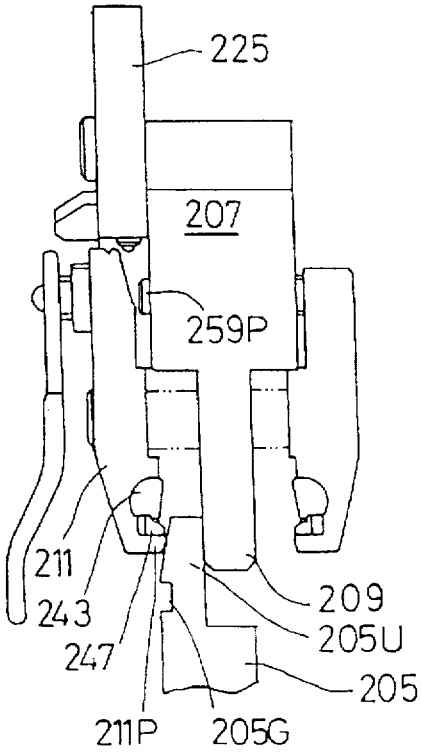

When the upper tool 205 is required to be clamped by the upper tool holder apparatus 201 from the lower side, the operation lever 265 is shifted counterclockwise to the vertical exchange position C, as shown in FIG. 14A. Under these conditions, since the lower portion of the upper tool clamp member 211 can be opened against an elastic force of the upper tool clamp member urging means 217, it is possible to insert the upper portion 205U of the upper tool 205 into between the upper tool support portion 209 of the holder body 207 and the upper tool clamp member 211 from below, as shown in FIG. 14B.

After the upper portion 205U of the upper tool 205 has been inserted between the upper tool support portion 209 of the holder body 207 and the upper tool clamp member 211, since the upper tool clamp member 211 is urged weakly in the clamping direction by the upper tool clamp member urging means 217, the engage projection 211P formed in the lower portion of the upper tool clamp member 211 is engaged with the drop prevention groove 205G formed in the upper tool 205.

Figure 15A:
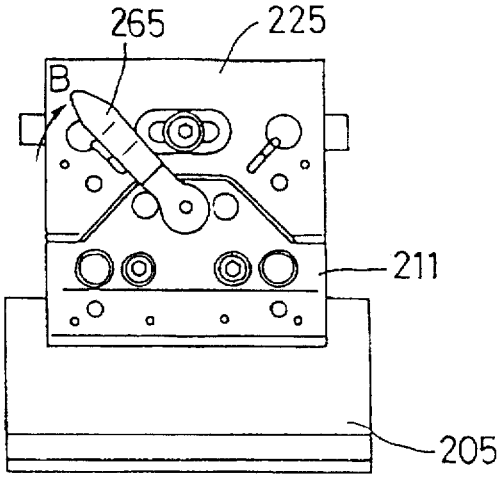
FIGS. 15A and 15B are illustrations for assistance in explaining the function when the operation lever is pivoted to the unclamp position B for upper tool adjustment.
Figure 15B:
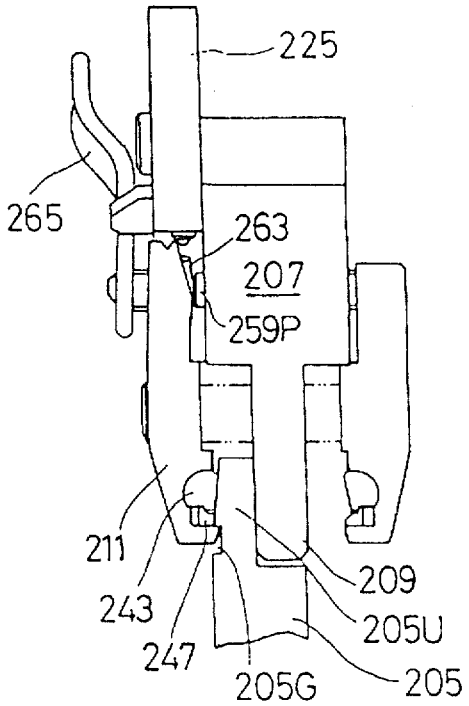

Under the condition that the engage projection 211P of the upper tool clamp member 211 is engaged with the drop prevention groove 205G of the upper tool 205, when the operation lever 265 is pivoted to the unclamp position B, as shown in FIG. 15A, since the pusher screw 263 is brought into slight contact with the pusher member 259P (the clamping force generating means 213), a slight clamping force is applied to the upper tool 205 and thereby the upper tool 205 is prevented from being dropped. Under these conditions, the upper tool 205 can be shifted in the horizontal (right and left) direction in FIG. 11, as shown in FIG. 15B. That is, under the condition that the operation lever 265 is pivoted to the unclamp position B, the upper tool 205 can be adjustably moved in the horizontal direction to locate the upper tool 205 relative to the upper tool holder apparatus 201. In this case, if the upper tool 205 is of split type, a plurality of split upper tools are arranged and located so as to be brought into contact with each other.

Figure 16A:
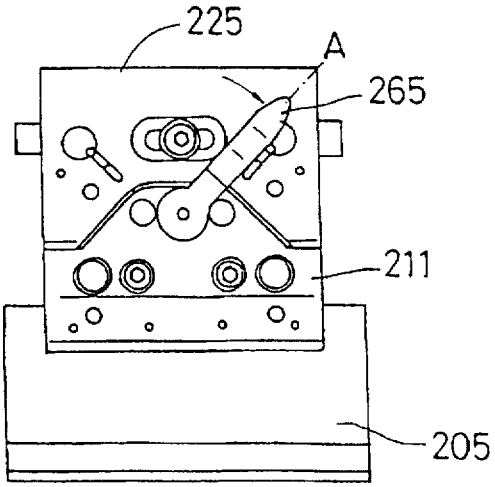
FIGS. 16A and 16B are illustrations for assistance in explaining the function when the operation lever is pivoted to the clamp position A for upper tool clamp.
Figure 16B:
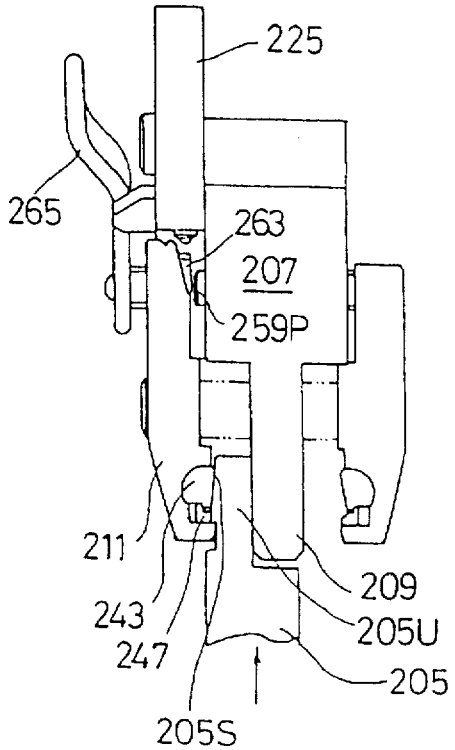

Under these conditions, when the operation lever 265 is pivoted to the clamp position A as shown in FIG. 16A, the upper tool 205 can be firmly clamped between the upper tool support portion 209 of the holder body 207 and the upper tool clamp member 211 of the upper tool holder apparatus 201. That is, since the pusher screw 263 pushes strongly the pusher member 259P of the clamping force generating means 213, the upper tool clamp member 211 firmly clamps the upper tool 205 in cooperation with the upper tool support portion 209 by a reaction force of the clamping force generating means 213 (the elastic member 257), as shown in FIG. 16B.

Figure 17A:
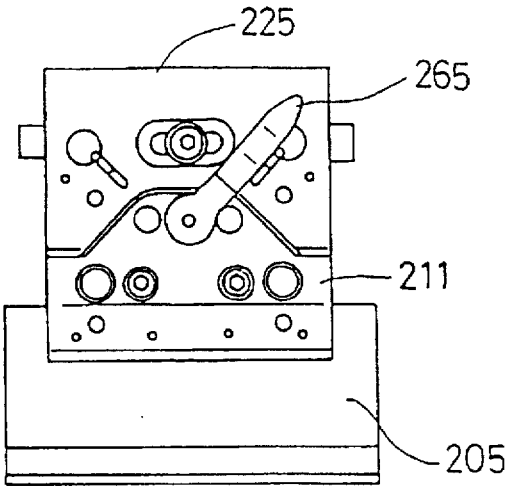
FIGS. 17A and 17B are illustrations for assistance in explaining the other function when the operation lever is pivoted to the clamp position A for alignment with the die.
Figure 17B:
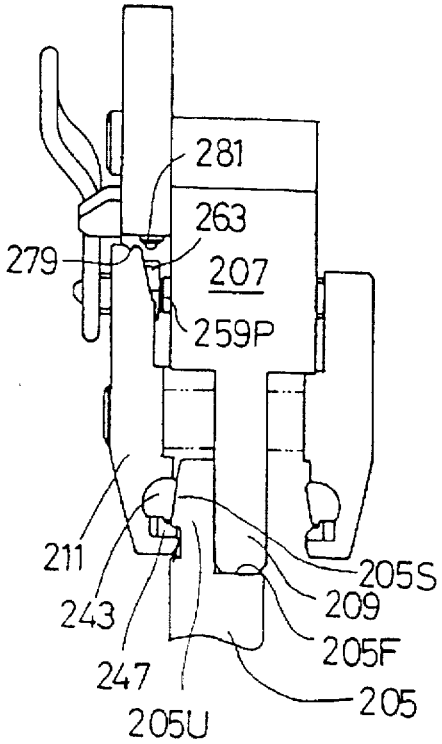

After that, when the movable-side table of the press brake is moved up and down to engage the upper tool 205 with the die (not shown), the upper tool 205 is inserted further upward between the upper tool support portion 209 and the upper tool clamp member 211, as shown in FIG. 17B.

In this case, since the inclined surface 205S of the upper tool 205 pushes the push contact member 243, when the upper tool 205 is moved upward relative to the upper tool clamp member 211, the upper tool clamp member 211 is pivoted clockwise in FIG. 12, so that the pusher screw 263 pushes the pusher member 259P of the clamping force generating means 213 gradually, with the result that the elastic force of the elastic member 257 further increases, until the shoulder portion 205F of the upper tool is brought into contact with the upper tool support portion 209. Therefore, it is possible to clamp the upper tool 205 by the upper tool clamp member 211 gradually more strongly.

Further, when the shoulder portion of the upper tool 205 is brought into contact with the lower end surface of the upper tool support portion 209, the upper tool 205 is clamped firmly between the upper tool clamp member 211 and the upper tool support portion 209, as shown in FIG. 17B. Further, as shown in FIGS. 12 and 17B, since the wedge piece 247 is engaged with the drop prevention groove 205G of the upper tool 205, a gap between the engage projection 211P and the drop prevention groove 205G can be reduced.

As described above, under the conditions that the wedge piece 247 is engaged with the drop prevention groove 205G of the upper tool 205, since a gap between the two is reduced, even if the upper tool clamp member 211 is released, the upper tool 205 will not drop by the weight thereof.

Figure 18A:
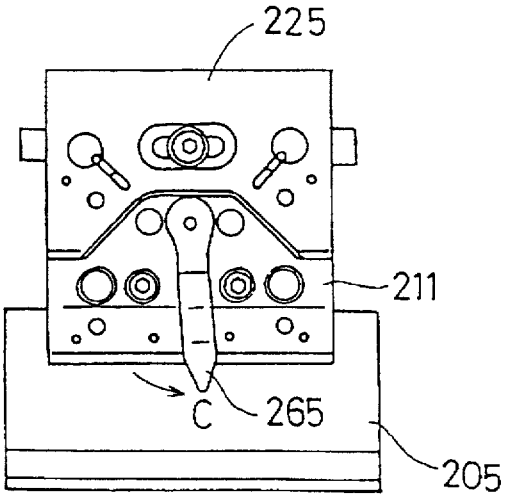
FIGS. 18A and 18B are illustrations for assistance in explaining the other function when the operation lever is pivoted to the exchange position C for upper tool exchange and further the upper tool clamp member is pivoted away from the upper tool to provide an exchange space.

Further, after the upper tool 205 has been clamped between the upper tool clamp member 211 and the upper tool support portion 209 and the work is bent in cooperation with the die, the upper tool 205 is required to removed from the upper tool holder apparatus 201, the operation lever 256 is pivoted counterclockwise to the vertical exchange position C, as shown in FIG. 18A.

Figure 18B:
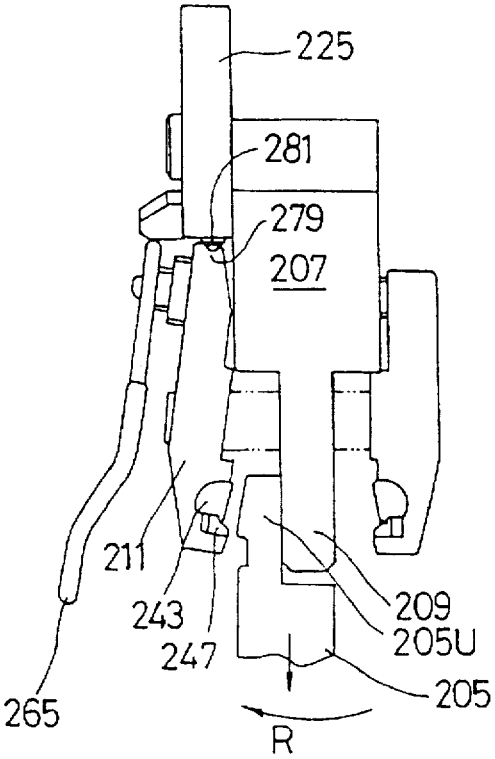

Under these conditions, since the upper tool clamp member 211 is released from the clamping force, the upper tool clamp member 211 can be pivoted clockwise (the arrow direction R) in FIG. 18B manually to engage the ball plunger 281 with the recess 279 of the upper tool clamp member 211, against an elastic force of the upper tool clamp member urging means 217, so that the lower portion of the upper tool clamp member 211 can be kept opened. Therefore, the upper tool 205 can be moved vertically downward, so that it is possible to remove the upper tool 205 from the upper tool clamp member 211 easily in the downward direction.

After the upper tool 205 has been removed in the downward direction, the operation lever 265 is pivoted clockwise to the unclamp position B once to disengage the engage recessed portion 279 from the ball plunger 281. After that, the operation lever 265 is pivoted counterclockwise again to the vertical exchange position C, as shown in FIG. 14A. Under these conditions, the upper tool 205 can be attached to the upper tool holder apparatus 211 again from below.

With reference to FIG. 12 again, a rear upper tool clamp member 283 can be pivotally attached on the rear surface (on the right side surface in FIG. 12) of the holder body 207 so that the upper tool 205 can be clamped by turning over the upper tool 205 from the front side to the rear side.

In more detail, on the rear surface of the upper tool support portion 207, a support pin 285 (which corresponds to the mounting bolt 239) is mounted horizontally with a fixing bolt 289 passed through a pipe-shaped spacer 287. Further, the rear upper tool clamp member 283 is pivotally supported by the support pin 285. Further, the head portion 291 of a bolt 291 mounted on the upper portion of the rear upper tool clamp member 283 is in contact with the head portion 251H of the adjust screw 251 of the clamping force generating means 213.

Further, an engage pin 293 fixed to the support pin 285 is engaged with a groove 283G formed in the rear upper tool clamp member 283, to prevent the support pin 285 from being pivoted relative to the rear upper tool clamp member 283.

The construction other than the above is the same as that of the upper tool clamp member 211, so that the same reference numerals have been retained for the similar elements which have the same functions as with the case of the front-side upper tool clamp member 211, without repeating the same description.

The upper tool 205 can be unclamped from the rear upper tool clamp member 283 by rotating the fixing bolt 289. Further, the upper tool 205 can be clamped by the rear upper tool clamp member 283 in the same way as with the case of the second prior art example, so that any detailed description thereof is omitted herein.

Further, without being limited to only the above-mentioned structure, various modifications can be made. For instance, a gaseous spring can be used as the clamping force generating means 213. Further, instead of the pusher screw (clamping force control member) 263, a cylindrical cam formed with three-stage cams brought into contact with the pusher member 259P can be adopted.

As described above, in the second embodiment of the upper tool holder apparatus according to the present invention, since the clamping force control means (the pusher screw) is thread-engaged with the upper tool clamp member and further since the clamp operation means (the operation lever) fixed to the pusher screw is selectively pivoted to the clamp position A for firmly clamping the upper tool, an unclamp position B for shifting the upper tool horizontally for upper tool adjustment and alignment, and further to the exchange position C for upper tool exchange, it is possible to adjust and exchange the upper tool easily and safely.

Further, since the upper tool clamp member urging means (the coil springs) are provided, when the operation lever is pivoted to the unclamp position B, the upper tool clamp member can be urged slightly in the clamp direction, so that it is possible to prevent the upper tool from being dropped during the upper tool adjustment or alignment.

Further, since the clamp release holding means (the engage recess and the ball plunger) are provided, when the operation lever is pivoted to the exchange position C, the upper tool clamp member can be kept away from the upper tool, so that it is possible to exchange the upper tool with a new one in the vertical direction easily.

Further, since the stopper members are provided for determining the clamp position A and the unclamp position B of the operation lever, it is possible to easily pivot the operation lever to the respective positions.

Further, since the wedge piece is provided on the engage projection of the upper tool so as to be engaged with the drop prevention groove of the upper tool, it is possible to reduce the gap between the engage projection of the upper tool clamp member and the drop prevention groove of the upper tool for improvement of the upper tool drop.

A third embodiment of the upper tool holder apparatus according to the present invention will be described hereinbelow with reference to FIGS. 19 and 20. In the drawings, an upper tool holder 301 of the present invention is removably attached to the lower portion of an upper table 303 of a press brake (not shown). In the present embodiment, although only one upper tool holder apparatus 301 is shown, in practice, however, a plurality of upper tool holder apparatus 301 are attached at appropriate intervals to the lower portion of the upper table 303.

The upper tool holder apparatus 301 is composed of a holder body 307 for supporting the upper tool 305, and an upper tool clamp member 309 for clamping the upper tool 305 in cooperation of the upper tool holder body 307.

In more detail, the upper tool holder body 307 is formed with a thick-wall upper block portion 311 and a thin-wall upper tool support portion 313 integral with each other. Further, a mounting plate 317 is fixed to the front surface (the right side in FIG. 20) of the upper block portion 311 of the upper tool holder body 307 with a plurality of bolts 315 (See FIG. 19).

Therefore, when the mounting plate 317 is brought into contact with the lower front surface of the upper table 303 and after that a clamp jaw 321 is fastened by a fastening bolt 319 thread-engaged with the upper table 303, the mounting plate 317 can be fixed to the upper table 303, so that the upper tool holer body 307 can be mounted to the upper table 303.

To adjust the vertical position of the upper tool holder body 307, a wedge member 323 extending horizontally in the right and left direction (in FIG. 19) is interposed between the upper surface of the upper block portion 311 and the lower surface of the upper table 303. A fixing bolt 325 passed through a slot 317H (See FIG. 20) formed in the mounting plate 317 so as to extend in the right and left direction is thread-engaged with the wedge member 323.

Figure 19:
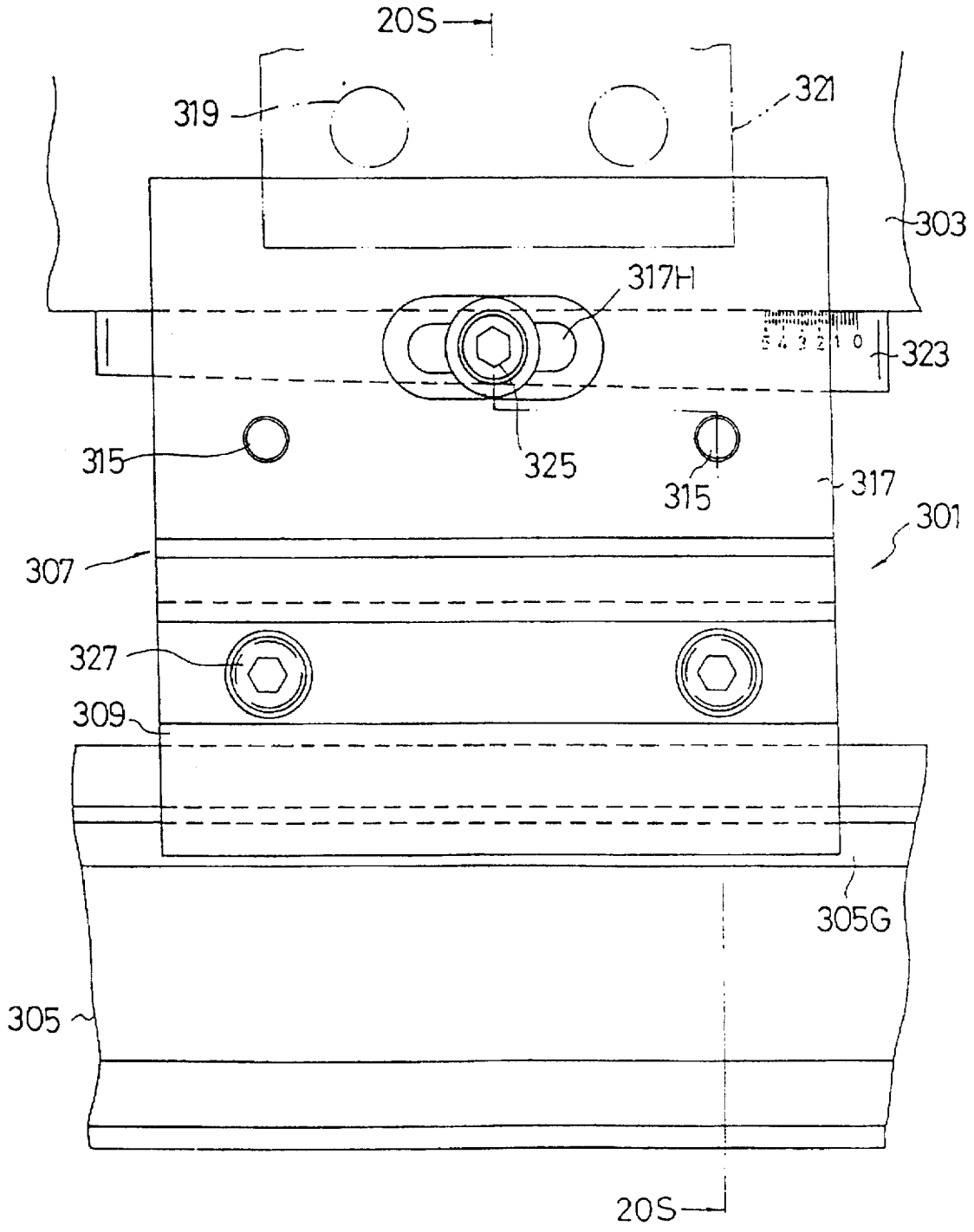
FIG. 19 is a front view showing a third embodiment of the upper tool holder apparatus according to the present invention.
Figure 20:
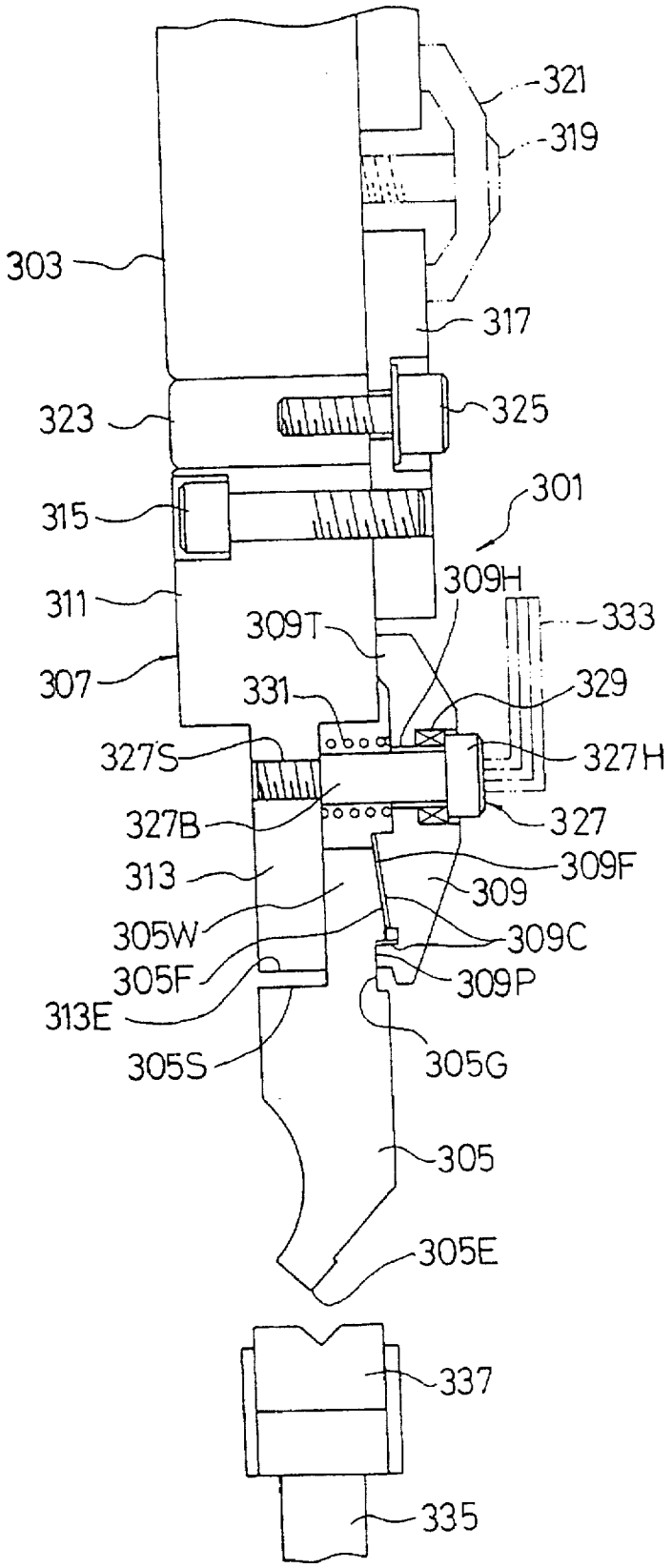
FIG. 20 is a cross-sectional view, taken along the line 20S—20S shown in FIG. 19.

In the above-mentioned construction, under the conditions that the fastening bolt 319 is slightly fastened to such an extent that the upper tool holder 301 does not drop, when the wedge member 27 is adjusted in the right and left direction in FIG. 19, it is possible to finely adjust the vertical position Of the upper tool holder body 307 relative to the upper table 303.

The upper tool clamp member 309 is formed by a plate member, and is pivotally (when seen in FIG. 20) supported by the upper tool holder body 307 via a bolt 327 (fastening means) passed through a through hole 309H formed in the upper tool clamp member 309.

A contact portion 309T is formed in the upper and inner surface of the upper tool clamp member 309 so as to be brought into contact with the front surface of the upper block portion 311 of the upper tool holder body 307, and an engage projection 309P engaged with an engage groove 5G of the upper tool 305 is formed at the lower portion of the upper tool clamp member 309 so as to project inward.

Further, an inclined surface 309F widened downward and brought into contact with an inclined surface 305F formed at the upper wedge portion 305W of the upper tool 305 is formed in the lower inner surface of the upper tool clamp member 309. As shown in FIG. 20, the inclined surface 309F is so inclined that the space between the upper tool support portion 313 of the upper tool holder body 307 and the upper tool clamp member 309 can be narrowed upward. Further, both the end edges of the inclined surface 309F and the upper surface of the engage projection 309P of the upper tool clamp member 309 are chamfered (309C) so that the upper tool 305 can be inserted smoothly between the upper tool support portion 313 and the upper tool clamp member 309 horizontally in the right and left direction in FIG. 19.

Further, the bolt 327 (fastening means) is formed with a small-diameter threaded portion 327S thread-engaged with the upper tool support portion 313 and a large-diameter body portion 327B, so that the upper tool clamp member 309 can be fastened by the bolt 327 always at a constant fastening position relative to the upper tool support portion 313.

Between the head portion 327H of the bolt 327 and the upper tool clamp member 309, an elastic member 329 (e.g., dish spring, urethane rubber, etc.) having a large coefficient of elasticity is interposed. Further, between the upper tool clamp member 309 and the upper tool support portion 313 of the upper tool holder body 307, a weak coil spring 331 is interposed to widen the space between the upper tool clamp member 309 and the upper tool support portion 313.

In the above-mentioned construction, to clamp the upper tool 305 by the upper tool holder apparatus 301, first the bolt 327 is previously fastened tightly to the upper tool support portion 313 by use of a fastening tool 333 (e.g., wrench). In this case, when the body portion 327B of the bolt 327 is brought into contact with the upper tool support portion 313, since the bolt 327 cannot be further fastened, it is possible to determine the distance between the upper tool support portion 313 and the head of the bolt 327 always at a constant value.

When the bolt 327 is fastened as described above, since the spring 331 is slightly compressed via the elastic member 329 and the upper tool clamp member 309, the space between the upper tool support portion 313 and the upper tool clamp member 309 can be kept opened at a previously determined constant value by an elastic force of the spring 331.

Under these conditions, the wedge portion 305W of the upper tool 305 is inserted into the above-mentioned space horizontally in the right and left direction in FIG. 19. In this case, since the chamfered surfaces 309C are formed in the upper tool clamp member 309, the wedge portion 305W of the upper tool 305 can be inserted smoothly between the upper tool support portion 313 and the upper tool clamp member 309.

Under these conditions, since the engage projection 309P of the upper tool clamp member 309 is engaged with the engage groove 305G of the upper tool 305, it is possible to prevent the upper tool 305 from dropping by the weight itself.

After the wedge portion 305W of the upper tool 305 has been inserted and located in position between the upper tool support portion 313 of the upper tool holder body 307 and the upper tool clamp member 309, the upper table 303 or the lower table 335 of the press brake is moved up and down relative to each other to engage the lower end portion 305E of the upper tool 305 with a die 337 mounted on the lower table 335. In this case, the upper tool 305 is moved upward relative to the upper tool holder body 307. When the shoulder portion 305S of the upper tool 305 is brought into contact with the lower end surface 313E of the upper tool support portion 313, the upper tool 305 stops moving upward and thereby the upper tool 305 can be located (setup) relative to the upper tool holder body 307.

As described above, when the upper tool 305 is moved upward relative to the upper tool holder body 307, since the inclined surface 305F of the wedge portion 305W of the upper tool 305 urges the inclined surface 309F of the upper tool clamp member 309, the space between the upper tool support portion 313 and the upper tool clamp member 309 is opened, so that the elastic member 329 is compressed.

In this case, since the space between the lower end surface 313E of the upper tool support portion 313 and the shoulder portion 305S of the upper tool 305 is always kept constant when the wedge portion 305W of the upper tool 305 is inserted between the upper tool support portion 313 and the upper tool clamp member 309, the compression rate of the elastic member 329 is always kept constant, as far as the upper tool 305 of the same dimension is inserted.

In other words, since the upper tool clamp member 309 is urged by an elastic force (the reaction force) of the elastic member 329, the wedge portion 305W of the upper tool 305 can be clamped between the upper tool clamp member 309 and the upper tool support portion 313. In this case, since being decided by the elastic force of only the elastic member 329, the clamping force is kept constant, as far as the upper tool 305 of the same wedge portion in dimension are clamped. Accordingly, it is possible to prevent the lower end portion 305E of the upper tool 305 from being dislocated slightly due to a difference in the clamping force of the upper tool clamp member 309, so that the lower end portion 305E of the upper tool 305 can be held always at a constant position.

In other words, even if the upper tools 305 are exchanged, as far as the same upper tools are used, it is possible to locate the lower end portion 305E of the upper tool 305 always at a constant position, so that it is possible to reproduce the accurate alignment of the upper tool with the die.

Therefore, work can be bent precisely in a plurality of steps by changing the upper tools. In the upper tool holder apparatus according to the present invention, since the reproducibility of the exchanged upper tools of the same dimensions in the wedge portion is excellent, as compared with the conventional upper tool holder apparatus, it is possible to improve the bending precision.

Further, the when the upper tool 305 is required to be removed from the upper tool holder apparatus 301, the bolt 327 is slightly loosened by use of the tool 333. In this case, the loosening rate of the bolt 327 is small, because the elastic force of the elastic member 329 is reduced to such an extent that the upper tool 305 can be moved. Therefore, it is possible to exchange the upper tool 305 easily by use of the upper tool holder apparatus 301 according to the present invention.

Figure 21:
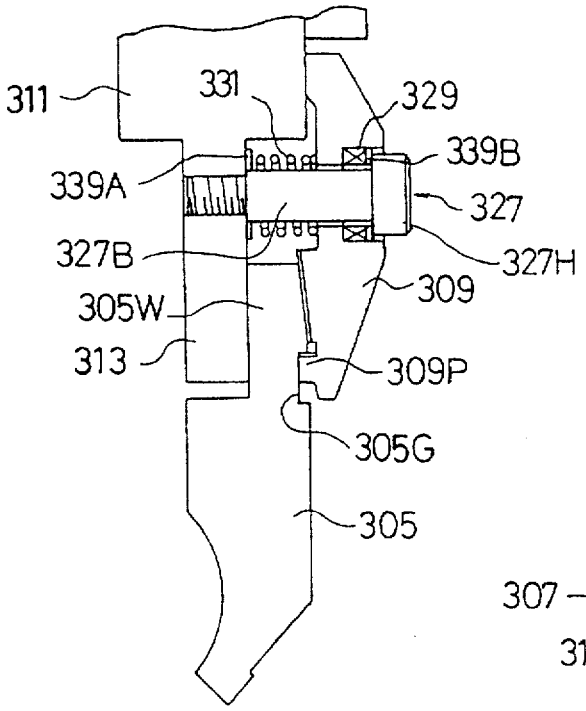
FIG. 21 is a side view showing a modification of the fastening means according to the present invention.

Further, when the fastening stroke of the bolt 327 is required to adjust, as shown in FIG. 21, an annular spacer 339A is interposed between the upper tool support portion 313 and the body portion 237B of the bolt 327.

Further, when the elastic force of the elastic member 329 is required to be adjusted, another spacer 339B is interposed between the upper tool clamp member 309 and the elastic member 329 or between the elastic member 329 and the head portion 327H of the bolt 327.

Figure 22:
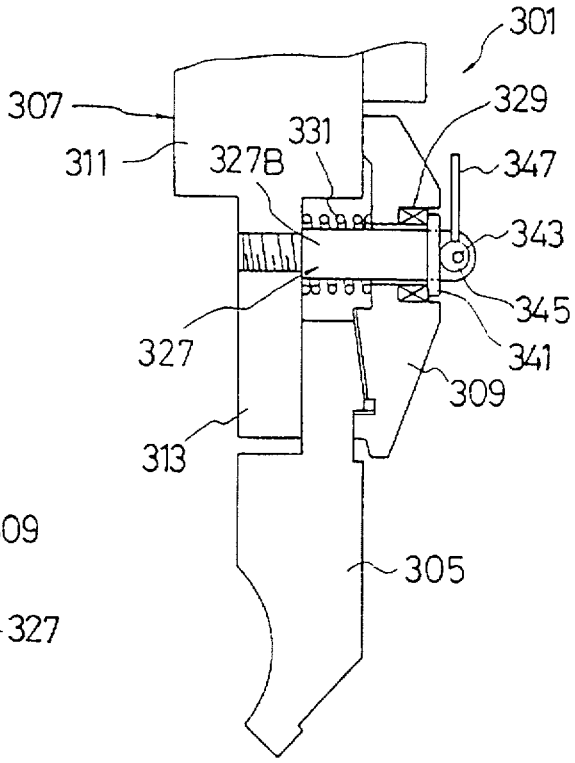
FIG. 22 is a side view showing another modification of the fastening member according to the present invention.

FIG. 22 shows a modification of the third embodiment. In this modification, the head portion of the bolt 327 shown in FIG. 20 is replaced with a push member 341, a lever 347 and a cam member 345. In more detail, the annular push member 341 is fitted to the body portion 327B of the bolt 327 so as to be brought into contact with the elastic member 329. The cam member 345 is pivotally supported by the bolt 327 via a pin 343. The lever 347 is attached to the cam member 345.

Therefore, after the bolt 327 has been fastened to the upper tool support portion 313, when the lever 347 attached to the cam member 345 is pivoted vertically, for instance as shown in FIG. 22, the push member 341 can be shifted by the cam member 345 by a predetermined distance, so that a space between the upper tool clamp member 309 and the annular push member 341 can be determined at a previously determined constant value to obtain a constant clamping force of the elastic means 329.

When the upper tool 305 is required to be released from the clamping force, the lever 347 is pivoted horizontally, for instance. Then, since the annular push member 341 is released via the cam member 345, the clamping force of the elastic member 239 can be released.

In this modification, the effect is the same as that of the third embodiment. Further, the clamp and unclamp conditions of the upper tool holder apparatus 301 can be confirmed easily by seeing whether the lever 347 is pivoted vertically or horizontally.

Figure 23:
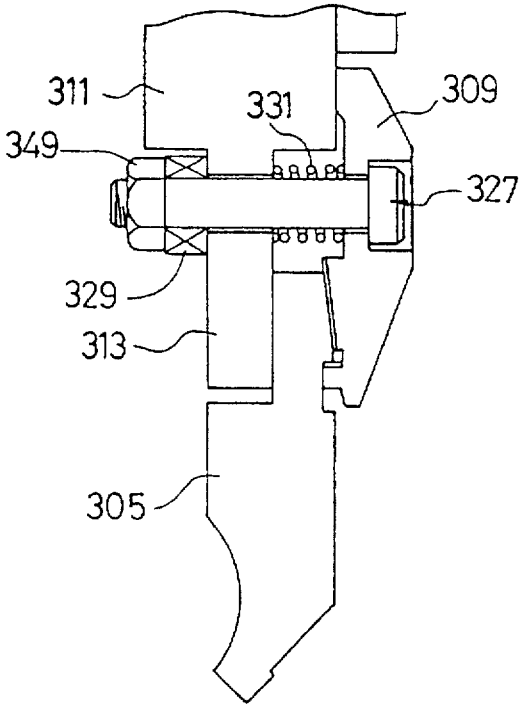
FIG. 23 is a side view showing still another modification of the fastening member according to the present invention.

FIG. 23 shows still another modification of the third embodiment. In this modification, the bolt 327 is passed through the upper tool support portion 313, and the elastic member 329 is interposed between a nut member (fastening member) 349 thread-engaged with the end portion of the bolt 327 and the upper tool support portion 313, without use of the elastic member interposed between the head portion 327H of the bolt 327 and the upper tool clamp member 309. In this modification, the upper tool 305 can be clamped at a constant clamping force, and thereby the same effect as described above can be obtained.

Figure 24:
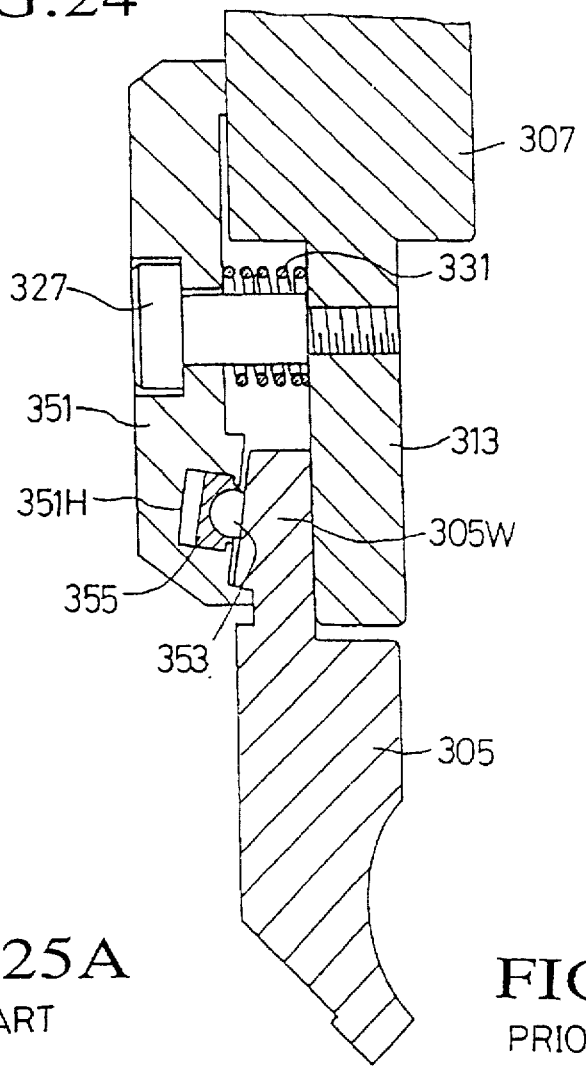
FIG. 24 is a side view showing the other modification of the fastening member according to the present invention.
Figure 25A:
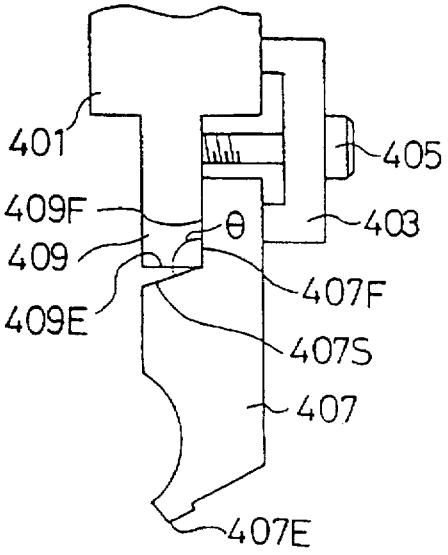
FIG.25A PRIOR ART
FIGS. 25A and 25B are partial side views showing a conventional upper tool.
Figure 25B:
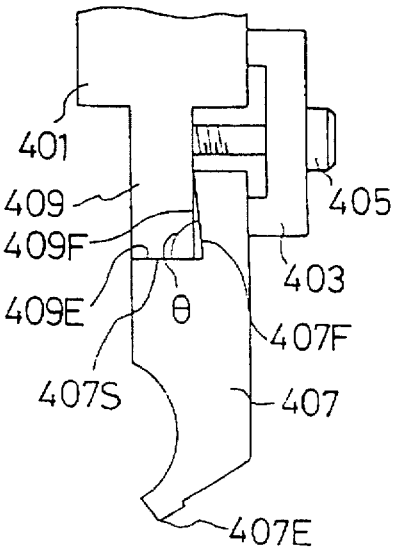
FIG.25B PRIOR ART

In the modification shown in FIG. 24, an upper tool clamp member 351 is formed with a hole 351H, and a semi-spherical clamp piece 353 fixed to a piston slider 355 is fitted to the hole 351. Further, a nitrogen gas is introduced into the hole 351H. The clamping force of the elastic means is adjusted by the pressure of the nitrogen gas introduced into the hole 351H. In this modification, the same effect can be obtained.

As described above, in the third embodiment of the upper tool holder apparatus according to the present invention, the upper tool can be exchanged easily by use of the upper tool holder apparatus. Further, whenever the upper tools of the same upper wedge dimension are exchanged, since the clamping force of the upper tool can be kept at a constant value, it is possible to obtain an excellent reproducibility of the alignment between the upper tool and the die, ever after the upper tools are exchanged for various bending process. As a result, the upper tool exchange work can be facilitated and further the bending precision can be improved.

What is claimed is:

1. An upper tool for a press brake, said upper tool for clamping to a holder body mounted on an upper table by a clamping force of an upper tool clamp member, said upper tool comprising:

a cross-sectional profile including a longitudinal axis;

an inclined surface angled with respect to said longitudinal axis and formed on a front side surface of said upper tool, said inclined surface extending from a top of said upper tool to an intermediate portion of said upper tool; and an engage groove formed in said intermediate portion of said upper tool and adjacent to said inclined surface.

2. An upper tool (9) for a press brake of claim 1, wherein said inclined surface is inclined with an inclination angle of 5°~20° to said longitudinal axis.

3. An upper tool (9) for a press brake of claim 1, wherein said inclined surface is inclined with an inclination angle of 7°~11° to said longitudinal axis.

4. An upper tool for a press brake of claim 1, wherein said upper tool is provided with a contact surface formed on a rear side surface opposite said front side surface.

5. An upper tool for a press brake of claim 1, wherein an upper groove surface of said engage groove, which is coupled to said inclined surface, is formed to be inclined with respect to a direction perpendicular to said longitudinal axis.

6. An upper tool for a press brake of claim 1, wherein said upper tool is formed on a rear side surface opposite said front side surface, and wherein an upper groove surface of said engage groove, which is coupled to said inclined surface, is formed to be inclined with respect to a direction perpendicular to said longitudinal axis.

7. An upper tool for a press brake of claim 1, wherein a coupling surface is formed parallel to said longitudinal axis to couple said inclined surface and said engage groove.

8. An upper tool for a press brake of claim 7, wherein an upper groove surface of said engage groove, which is coupled to said inclined surface, is slightly inclined with respect to a direction perpendicular to said longitudinal axis.

9. An upper tool for a press brake of claim 1, wherein the inclined surface of the upper tool is hardened by attaching a hard metal on the surface thereof.

10. An upper tool for a press brake of claim 1, wherein the inclined surface of the upper tool is hardened by coating a hard metal on the surface thereof.

11. An upper tool for a press brake of claim 5, further comprising a shoulder portion formed on a rear side surface opposite said front side surface and perpendicular to said longitudinal axis; and said upper tool in combination with the holder body and the upper tool clamp member such that a height of said inclined surface with respect to said longitudinal axis when said engage groove engages an engage projection of the upper tool clamp member and said upper groove surface contacts the engage projection is more than a gap between a lower end surface of the holder body and a shoulder portion of said upper tool.

12. An upper tool for a press brake in combination with an upper tool holding device mounted on an upper table of said press brake, said upper tool combination comprising:

an clamp portion having a contact surface brought into contact with a lower surface of a support plate provided on a holder body of said upper tool holding device, a slide surface slidably brought into contact with a front or rear surface of said support plate, an inclined surface brought into pressure contact with an upper tool clamp section of an upper tool clamp member of said upper tool holding device, and an engage groove for engaging with an engage projection formed in said upper tool clamp member, said engage groove formed on a side surface on which said inclined surface is formed; and a work processing portion for processing a workpiece in cooperation with a lower tool, said work processing portion is provided on a lower end of said upper tool.

13. An upper tool assembly for a press brake, said upper tool being detachably mounted between a support plate and an upper tool clamp member, said support plate being arranged on a lower part of a holder body in an upper tool holder attached on an underside of an upper table of said press brake, said upper tool clamp member being pivotably mounted to said upper tool against said support plate, said upper tool assembly comprising:

a contact surface which is capable of contacting with a lower end surface of said support plate, said contact surface extending perpendicularly to a longitudinal axis of a cross-section of said upper tool and formed on a first side surface of said upper tool;

a sliding surface which is capable of sliding on a front surface or rear surface of said support plate, extending parallel to said longitudinal axis and coupled to said contact surface on said first side surface;

an inclined surface for pivoting said upper tool clamp member to increase a clamp force of said upper tool due to said upper tool clamp member when said upper tool relatively moves with respect to said support plate so that said contact surface comes into contact with said lower end surface of said support plate, said inclined surface formed on a second side surface opposite said first side surface;

an engage groove for engaging with an engage projection formed in said upper tool clamp member, said engage groove formed on said side surface on which said inclined surface is formed; and a processing part for cooperating with said lower tool of said press brake to process a work, said processing part provided on one end of said upper tool;

wherein, in a condition under which a side wall of said engaging groove provided in said upper tool is supported by an engaging projection provided in said upper tool clamp member, a distance H between said lower end surface of said support plate and said contact surface of said upper tool can be calculated by a following expression:

$$H=[(B^{2\cdot F})]/[(A^2\cdot k\cdot \tan\theta)]$$

wherein

A represents a dimension of distance from a pivot center of said upper tool clamp member through an elastic means for pressing said upper tool clamp member;

B represents a mean distance from said pivot center through a pressing point at which said upper tool clamp member presses said upper tool against said support plate;

P represents a pressing force by which said upper tool is pressed against said support plate;

K represents an elastic coefficient of said elastic means; and

θ represents a slant angle of said inclined surface.

14. An upper tool assembly for a press brake, elastically clamped between a support plate of an upper tool holder body attached to a lower portion of an upper table and an upper tool clamp member, said upper tool comprising:

an inclined surface narrowed toward one end of said upper tool; and an engage groove for engaging with an engage projection of said upper tool clamp member and formed adjacent said inclined surface, said inclined surface being brought into flush contact with a surface of said upper tool clamp member when said upper tool is clamped between said upper tool holder body support plate and said upper tool clamp member, wherein a clamping force on said upper tool can be increased when an other end of said upper tool is engaged with a die.

15. An upper tool assembly for a press brake of claim 14, wherein an inclination angle (θ) of said inclined surface of said upper tool is about 7 to 11 degrees from a longitudinal axis of said upper tool extending from said one end to said other end.

16. An upper tool for a press brake of claim 14, wherein said engage groove of said upper tool is defined by a first side wall and a second side wall, said first side wall adjacent said inclined surface and said second wall formed below said first wall with respect to said one end; and said first wall formed at a position with respect to longitudinal axis extending between said one end and said other end of said upper tool which closer to said one end of said upper tool than a contact surface of said upper tool to be brought into contact with a lower end surface of said support plate of said holder body.

17. An upper tool assembly for a press brake of claim 14, wherein a short coupling surface is formed between said inclined surface and said engage groove and couples said inclined surface and said engage groove to allow said upper tool to be clamped by a conventional upper tool apparatus.

18. An upper tool for a press brake of claim 14, wherein said engage groove of said upper tool is defined by a first side wall and a second side wall, said first side wall adjacent said inclined surface and said second side wall positioned below said first side wall with respect to said one end of said upper tool; and said first side wall of said engage groove being slightly inclined from a direction perpendicular to a longitudinal axis extending between said one end and said other end of said upper tool to urge said upper tool against said support plate.

19. An upper tool for a press brake of claim 14, wherein a shoulder with a contact surface is formed on a first side surface of said upper tool, said engage groove being defined by a first side wall and a second side wall, said first side wall being adjacent said inclined surface and said second side wall being positioned below said first side wall with respect to said one end of said upper tool; and a distance H between said lower surface of said support plate and said contact surface of said upper tool obtained when said first side wall of said engage groove of said upper tool is in contact with said engage projection of said upper tool clamp member being determined as follows:

$$H=[(B^2\cdot P)]/[(A^2\cdot k\cdot \tan\theta)]$$

where A denotes a distance between a pivotal center of said upper tool clamp member and elastic means for generating a clamping force to said upper tool clamp member;

B denotes an average distance between said pivotal center of said upper tool clamp member and a clamping force application point;

P denotes said clamping force applied to said upper tool clamp member;

K denotes an elastic coefficient of said elastic means; and

θ denotes the inclination angle of the inclined surface of said upper tool with respect to a longitudinal axis extending between said one end and said other end of said upper tool.

20. An upper tool for a press brake of claim 14, wherein said inclined surface of said upper tool is hardened by attaching a hard metal on said surface thereof.

21. An upper tool for a press brake of claim 14, wherein said inclined surface of said upper tool is hardened by coating a hard metal on said surface thereof.

* * * * *